US012084997B1

(12) United States Patent
Christensen

(10) Patent No.: US 12,084,997 B1
(45) Date of Patent: Sep. 10, 2024

(54) OIL EVACUATION SYSTEM AND METHOD OF USE

(71) Applicant: AGA Tools & Products, Inc., Escondido, CA (US)

(72) Inventor: Hans Martin Christensen, Escondido, CA (US)

(73) Assignee: AGA Tools & Products, Inc., Escondido, CA (US)

( * ) Notice: Subject to any disclaimer, the term of this patent is extended or adjusted under 35 U.S.C. 154(b) by 0 days.

(21) Appl. No.: 17/586,577

(22) Filed: Jan. 27, 2022

(51) Int. Cl.
*F01M 11/04* (2006.01)

(52) U.S. Cl.
CPC ..... *F01M 11/0408* (2013.01); *F01M 2011/0425* (2013.01)

(58) Field of Classification Search
CPC ..... F01M 11/0408; F01M 2011/0416; F01M 2011/0425
See application file for complete search history.

(56) References Cited

U.S. PATENT DOCUMENTS 3,052,256 A * 9/1962 Smirles ..... F16K 51/00 222/539
3,103,947 A * 9/1963 Mueller ..... F01M 11/0408 137/853
3,171,440 A * 3/1965 Napolitano ..... F16K 1/42 251/210
3,720,287 A * 3/1973 Martel ..... F01M 11/0458 180/6.5
3,905,451 A * 9/1975 Williamson ..... F16N 27/00 184/7.4
4,354,523 A * 10/1982 Hochmuth ..... F16L 29/007 251/339
6,234,274 B1 * 5/2001 van der Griendt ..... F01M 11/0408 285/94
6,902,038 B2 * 6/2005 Takahara ..... F01M 11/045 251/149.6
9,752,473 B1 * 9/2017 Burns ..... F01M 11/0408
(Continued)

FOREIGN PATENT DOCUMENTS

JP H08170782 A * 7/1996 ..... F01L 55/00
TW M248650 U * 11/2004 ..... F01M 11/0408

OTHER PUBLICATIONS

"The stahlbus oil drain valve" web page at http://www.stahlbus.com/products/en/oil-drain-valve/index.php accessed on Mar. 31, 2023.

(Continued)

*Primary Examiner* — Minh Truong
(74) *Attorney, Agent, or Firm* — Master Key IP, LLP; Jeromye V. Sartain

(57) ABSTRACT

An oil evacuation system for draining oil from an oil pan includes an oil drain plug configured to threadably engage the oil pan drain hole and having a spring-biased plunger positioned within the throat of the plug bore and configured to selectively seal the plug bore, a safety cap configured for selective threadable engagement with the plug, and an oil drain tool configured for selective operable installation on the plug upon removal of the cap when the plug is installed in the drain hole and oil is to be drained from the oil pan, the tool having an actuator for selective engagement with and displacement of the plug valve plunger to open the plug and the tool and allow oil to flow out of the oil pan.

22 Claims, 10 Drawing Sheets

(56) References Cited

U.S. PATENT DOCUMENTS

| | | | | |
|---|---|---|---|---|
| 11,415,488 | B2 * | 8/2022 | Marchand | G01N 1/2035 |
| 2003/0089874 | A1 * | 5/2003 | Hall | F16L 29/02 251/149.6 |

OTHER PUBLICATIONS

Stahlbus "Operating instructions Oil drain valve" manual as downloaded from http://www.stahlbus.com/info/en/service/downloads/operating-manuals-modes-d-emploi on Mar. 31, 2023.

Stahlbus "Operating instructions for Oil drain valve tool" manual as downloaded from http://www.stahlbus.com/info/en/service/downloads/operating-manuals-modes-d-emploi on Mar. 31, 2023.

"EZ Oil Drain Valve EZ-7B—EZ Oil Drain Valve (EZ-7B) 22mm-1.5 Thread Size" product page at https://www.finditparts.com/products/9417649/ez-oil-drain-valve-ez-7b?srcid=CHL01SCL019-K9417649-_413&msclkid=eae873b87fed183466e612cf5a2ac7c6&utm_source=bing&utm_medium=cpc&utm_campaign=Shopping%20Campaign%20-%20Primary&utm_term=4580496733734688&utm_content=All%20Products accessed on Mar. 31, 2023.

"EZ Oil Drain Valve A-108—EZ Oil Drain Valve Adapter (A-108) 16mm-1.5 Thread Size" product page at https://www.finditparts.com/products/9417657/ez-oil-drain-valve-a-108?srcid=CHL01SCL019-K9417657-_413&msclkid=b7255844bcd314e2269039339bed1e68&utm_source=bing&utm_medium=cpc&utm_campaign=Shopping%20Campaign%20-%20Primary&utm_term=4580496733734688&utm_content=All%20Products accessed on Mar. 31, 2023.

RPM Industries "Self Contained Oil Evacuation Tool (SCET)" web page at http://www.rpmindustries.com/self-contained-oil-evacuation-tool.html accessed on Mar. 31, 2023.

SP Tools "Oil Drain Hose—M20X 1.5P—Toyota & Lexus" web page at https://www.sptools.com/product-catalogue/speciality-tools-workshop-and-lighting/engine/engine-service-tools/oil-drain-hose-m20-x-15p-toyota-and-lexus/ accessed on Mar. 31, 2023.

Drainzit "Drainzit Oil Drain Hoses" web page at https://drainzit.com/ accessed on Mar. 31, 2023.

* cited by examiner

OIL EVACUATION SYSTEM AND METHOD OF USE

BACKGROUND

The subject of this patent application relates generally to engine parts and tools, and more particularly to plugs and connectors configured for selectively removing oil from an engine oil pan.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, oil changes for internal combustion engines are one of the most basic and common maintenance activities that consumers, owner-operators, and technicians perform in connection with automobiles, boats, heavy equipment, generators, and the like to keep them running optimally. As common as oil changes are, they have fundamentally been done the same way for decades without any real improvement in the process, which still involves inconvenience and hassle, risks of oil spills, and even hazards if the oil is still hot when drained as well as related adverse health and environmental impacts associated with the oil draining process and cleanup afterward.

In the most common scenario for draining the oil from an engine oil pan (the tray-like steel or aluminum pan mounted on the engine block), access to the area adjacent to the oil pan is gained, often involving jacking up the vehicle or removing parts around the oil pan, the drain plug is threadably removed from the oil pan drain hole, and the oil then simply gravity-flows from the oil pan into a receptacle placed beneath the oil pan drain hole. Inevitably, as the drain plug is removed, oil gets on the operator's hand and splashes the surrounding area as the initial flow of oil strikes the drain plug, the operator's hand, and surrounding structure. Again, if the oil is still hot at the time it is drained, there is a burn hazard, and regardless, the oil that has splashed and made a mess must be cleaned up using time and materials that otherwise could have been avoided, leading to waste and possible health and environmental adverse effects such as when brake cleaner is used.

In particular vehicle makes and models such as various BMWs, a chassis stiffening plate is installed adjacent to the oil pan having a relatively small hole (on the order of six inches) formed in the plate for accessing the oil pan drain plug and drain hole. Oil splashing on the back or top side of such a stiffening plate adds further challenges for cleanup or can lead to later oil drips to the dissatisfaction of the owner-operator or customer. As such, an oil change on such vehicles often involves wasted time and materials as by either removing and reinstalling the stiffening plate (which typically is secured with numerous one-time fasteners) or stuffing shop rags or the like around the opening in the stiffening plate between it and the oil pan in an attempt to prevent oil from splashing into that area, in either case again often involving some degree of cleanup including the use of harsh chemicals.

Accordingly, the typical oil change process involving the removal of a standard oil drain plug (essentially, a solid threaded bolt) from the threaded drain hole of the oil pan is not at all well suited to mobile service even by trained technicians let alone the everyday do-it-yourselfer.

Recognizing such drawbacks of the conventional oil change process, alternate solutions have been proposed in recent years as effectively involving a drain plug having a valved through-hole formed in the plug and a means of connecting a drain line to the valved drain plug and thereby activating or opening the plug valve to allow the oil to drain out of the pan through the installed plug and connected line without actually removing the plug. However, such valved drain plugs that have been proposed and are available on the market still have numerous deficiencies, ranging from being too bulky to be safely or effectively installed in the oil pan, to being difficult to operate or connect the drain line to, to still allowing drips or spills during connection or disconnection. Particularly, a drain plug that is not substantially flush with the oil pan or does not have a relatively low profile but that instead has an excessive portion of the plug extending downward from the oil pan presents a hazard such as during a collision being subject to shearing off and/or sparking when contacted by surrounding metal parts. Furthermore, many such third-party valved drain plugs are made of brass, which is non-ferrous and thus resistant to corrosion and sparking but is also relatively soft and subject to lower torque limits, such as up to only 9-12 ft-lb, well below most manufacturer's specifications, and are quite bulky with much of the plug exposed outside of the oil pan, even up to one-and-a-half inches or more, which again presents shear risks as well as even potentially vibrating loose over time due to the bulk or mass of the plugs in combination with their relatively lower torque capacity.

An exemplary third-party valved drain plug is sold by German company Stahlbus GmbH as a replacement for and improvement over a standard oil drain plug and even other valved drain plugs, though again with several drawbacks. First, the construction of the Stahlbus oil drain valve, including the length of its threaded shaft, is such that it cannot be torqued to manufacturer specs such as from BMW (Stahlbus limiting the torque to 18 ft-lb or about 24.4 N-m when BMW's standard drain plug torque spec is 28 N-m). Relatedly, as with other third-party valved plugs that are to remain in the oil pan, the threaded shaft of the Stahlbus valve being on the order of 14 mm in length, as compared to the typical 16 mm length drain plug shaft, and accounting for some oil pans only being about 5-7 mm thick in the vicinity of the oil drain hole, the Stahlbus valve will extend above the bottom surface of the oil pan by 7-9 mm and, since it is of course not removed during oil evacuation, will thus prevent a portion of the oil in the pan from ever draining (e.g., some BWM and other aluminum oil pans have a threaded portion of the oil pan drain hole extending interiorly into the pan in the form of a vertically slotted threaded boss for allowance of oil drainage down to the bottom of the pan after the standard oil drain plug is removed, which would flow through the slot of the interior threaded boss, but which slot would be blocked and such oil drainage prevented by the Stahlbus and other third-party oil drain valves). And perhaps most significantly, the Stahlbus oil drain valve head opposite its threaded shaft and related installed safety cap still stands off from the oil pan about 24 mm or nearly one inch, which again poses a risk in a collision and so is unacceptable in many applications.

What is still needed and has heretofore been unavailable is an improved oil evacuation system and related drain plug and evacuation connector tool that has a relatively low profile on the outside of the oil pan, that allows for substantially all of the oil to be drained from the oil pan, that allows for shut-off in such a way as to eliminate oil drips or leaks, and that otherwise meets expectations in terms of performance and safety. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a new and novel oil evacuation system. In at least one embodiment, an oil evacuation system according to aspects of the present invention for draining oil from an oil pan having a drain hole comprises an oil drain plug having a distal threaded plug shaft, an intermediate plug head, and a proximal threaded plug boss, the plug shaft configured to threadably engage the oil pan drain hole, the plug further having an axial plug bore therealong, the plug bore having formed therein proximally a relatively larger diameter throat opposite the plug head, the plug further having a plunger positioned within the throat and configured to selectively seal the plug bore under the biasing effect of a spring extending distally from the plunger, a safety cap configured for selective threadable engagement with the plug boss for selectively proximally covering the plug, in one embodiment formed of a non-ferrous metal such as aluminum, and an oil drain tool configured for selective operable installation on the plug upon removal of the cap when the plug is installed in the drain hole and oil is to be drained from the oil pan, the tool comprising a body having a distal threaded connector and a proximal threaded tool boss, the connector configured to threadably engage the plug boss, the tool further having an axial tool bore therealong, the tool bore having a distal cavity defining the threaded connector and a relatively smaller diameter intermediate bore relief, the tool further having an actuator slidably and selectively sealingly installed within the tool bore and configured for selective engagement with the plunger, wherein the stand-off of the plug from the plug head to the plug boss is less than nine millimeters (9 mm) and with the cap installed on the plug boss is less than ten millimeters (10 mm), whereby the plug has a relatively low profile when installed in the drain hole of the oil pan, and wherein during use when the plug is installed in the drain hole and oil is to be drained from the oil pan, upon removal of the cap from the plug and threadable installation of the tool on the plug, actuation of the actuator of the tool causes the actuator to engage and unseat the plunger of the plug within the plug bore and thereby allow the flow of oil through the plug around the plunger and through the tool around the actuator.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
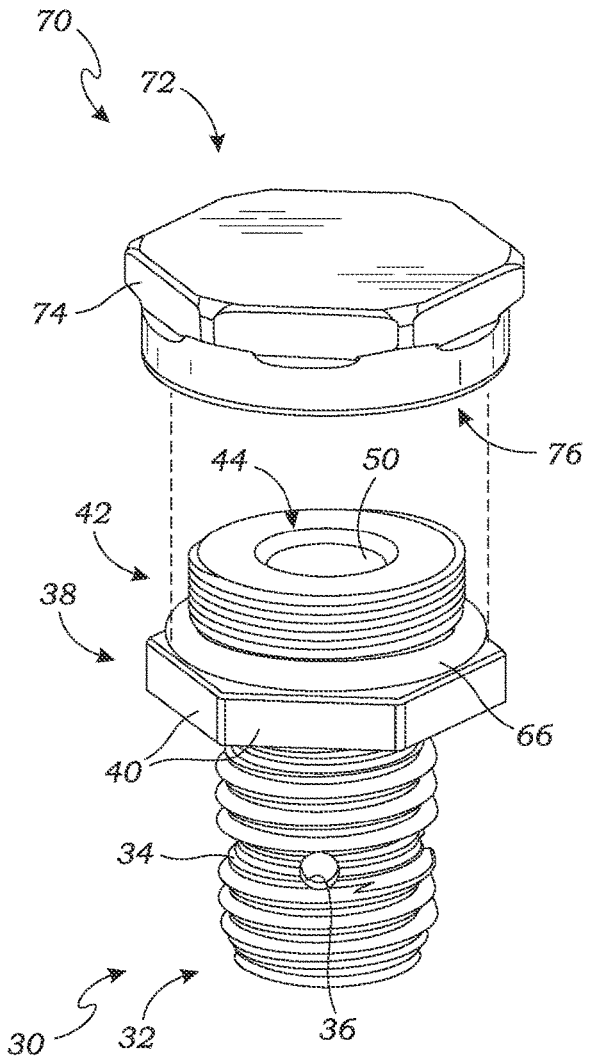
FIG. 1 is a perspective view of an exemplary oil drain plug with adjacent safety cap not yet assembled, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus or system according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Figure 2:
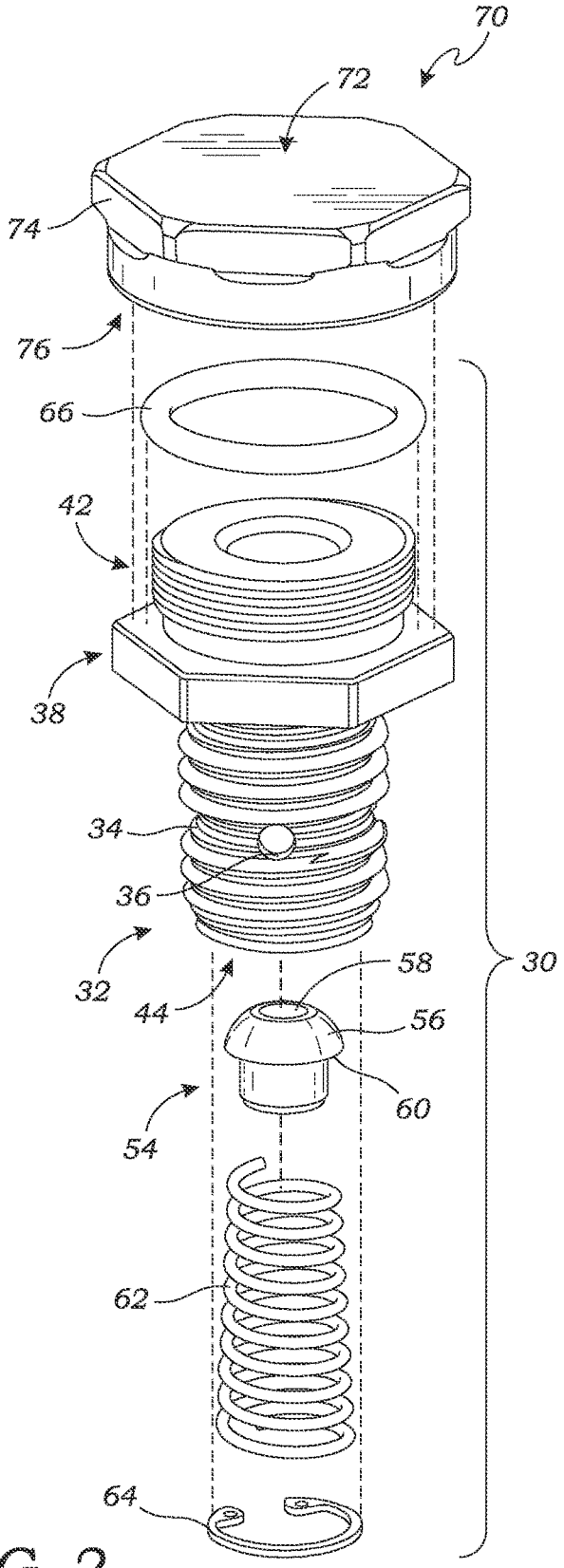
FIG. 2 is an exploded perspective view thereof, in accordance with at least one embodiment.
Figure 3:
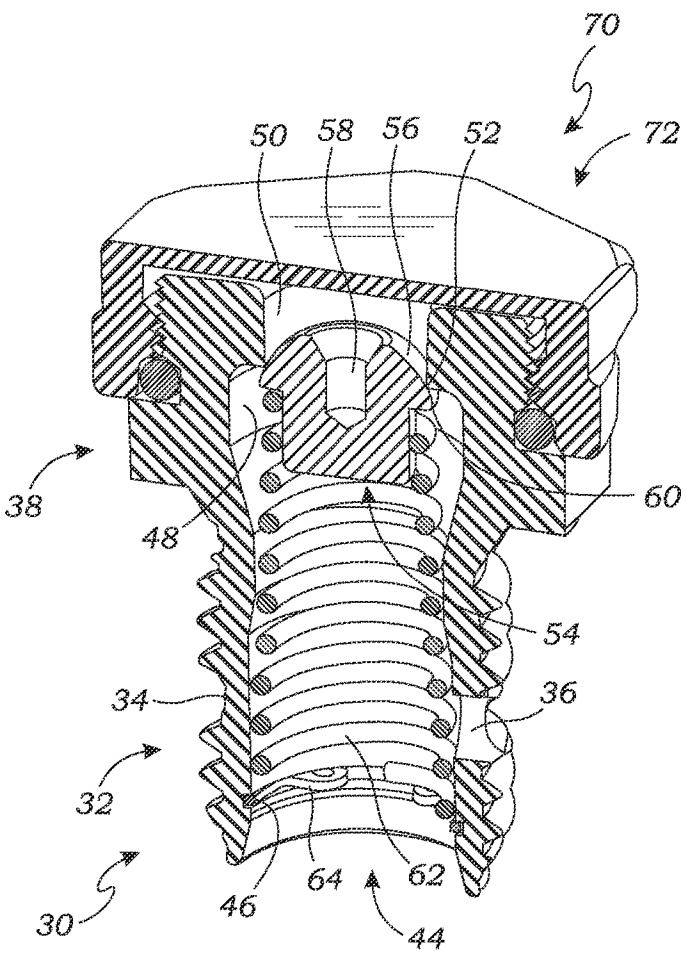
FIG. 3 is an enlarged cross-sectional perspective view thereof as fully assembled, in accordance with at least one embodiment.

Turning now to FIGS. 1-3, there are shown standard, exploded, and cross-sectional perspective views of an exemplary embodiment of an oil drain plug 30 with removable safety cap 70 according to aspects of the present invention. As a threshold matter, "distal" or "distally" is used throughout to describe a direction or orientation toward the oil pan and "proximal" or "proximally" is used throughout to describe a direction or orientation away from the oil pan. The oil drain plug 30 generally comprises, in the exemplary embodiment, a distal threaded shaft 32 configured for selectively engaging a threaded oil pan drain hole H (FIGS. 12 and 13) and a proximal threaded boss 42 for being selectively engaged by either a safety cap 70 when the plug 30 is not in use or the oil drain tool 80 (FIGS. 4-8) when the plug 30 is in use. A head 38 is formed on the plug 30 intermediate the distal threaded shaft 32 and the proximal threaded boss 42 and configured with a conventional hex profile having offset flats for mechanical engagement with the plug 30 as by a wrench or socket (not shown) when the plug 30 is threadably installed in or removed from an oil pan P (FIGS. 9 and 10), noting for example that in certain BMW models the oil drain plug 30 is to be torqued to 28 N-m. And an o-ring 66 is removably installed on the plug 30 at the shoulder or interface between the head 38 and the boss 42 to facilitate sealing between either the safety cap 70 or the oil drain tool 80. Internally, the drain plug 30 is formed having a lengthwise or axial bore 44 communicating between the proximal and distal ends thereof, or between the proximal boss 42 and the distal shaft 32, and thereby providing a central conduit for the selective passage through the drain plug 30 of oil O (FIG. 14) during use as when evacuating oil O from the oil pan P, as described below in connection with FIGS. 9-14. As shown, a new and novel circumferential groove 34 is formed at an intermediate location about the threaded shaft 32 with a cross-hole 36 formed therein so as to intersect the groove 34 as well as the internal bore 44 and thus provide for fluid communication between the groove 34 and bore 44, more about which is said below. The bore 44 is uniquely formed having a proximal relatively wider 20) throat 48 in the vicinity of the interface between the head 38 and the boss 42 and terminating proximally in a relatively narrower through-hole 50, such that a sealing surface or edge 52 is formed at the interface or transition between the throat 48 and the through-hole 50, whether as a line or corner or a surface, in either case providing a seating and sealing surface 52 for a plunger 54 operating within the valve plug 30. The plunger 54 is configured to effectively float within the bore 44, or more particularly within the throat 48, and to selectively seat and seal against the edge surface 52 and thereby selectively open and close the bore 44. In the exemplary embodiment, the plunger 54 is biased upwardly or proximally toward and against the edge 52 by a coil spring 62 installed within the bore 44 and retained proximally against a distally-facing shoulder 60 of the plunger 54 and retained distally by a retaining ring 64 seated within an undercut 46 formed in the bore 44 such that the proximally-facing somewhat domed surface 56 of the plunger 54 seals on the edge 52 under the biasing effect of the spring 62 to selectively close or seal off the oil drain plug bore 44. Also formed proximally in the plunger 54 is a proximally-opening countersunk hole 58 configured for engagement by an actuator 142 of the oil drain tool 80 during use as shown and described further below in connection with FIGS. 7 and 8. The separate safety cap 70 is configured having a head 72 with a conventional hex profile having offset flats 74 for mechanical engagement as again through a wrench or socket tool. The safety cap 70 may in some contexts be hand-tightened, and so optionally the head 72 may instead be formed with knurled or other grip surfaces (not shown). Regardless, the safety cap 70 is further formed opposite the proximal head 72 with a distally-opening cavity 76 formed with female threads configured for engagement with the threaded boss 42 of the oil drain plug 30 again when the plug 30 is not in use and the cap 70 is secured thereon. Though not shown, the cap 70 may also be inscribed with safety or instructional information, for example, regarding what it should be torqued to, such as 60 cN-m, which torque is sufficient to compress the o-ring 66 between the safety cap 70 and the head 38 of the drain plug 30 to seal and retain the safety cap 70 on the plug 30.

Dimensionally, in the exemplary embodiment, an oil drain plug 30 according to aspects of the present invention may be configured with its threaded shaft 32 being a conventional and nominal 12×1.5 mm, 14×1.5 mm, or 18×1.5 mm diameter and pitch for engagement with a conventional oil pan drain hole H (FIGS. 12 and 13) such as found on most BMW models and some other brands, with the length of the shaft 32 in each case being approximately 16 mm as for typical oil drain plugs. Those skilled in the art will appreciate that the threaded shaft 32 can of course vary widely to suit other vehicle makes and models, and their oil pan drain holes specifically, including but not limited to a nominal 14×1.4 mm for some BMW models and Mercedes, Audi, Volkswagen, and other brands, 14×1.25 mm for Toyota and Honda models and other brands, and 16×1.5 mm, 18×1.5 mm, and 20×1.5 mm for Subaru and other brands, and thus the threaded shaft 32 can be formed of any diameter and pitch and length as appropriate for the oil pan drain hole of any vehicle or other commercial application now known or later developed or identified. In any event, the circumferential groove 34 may be located along the shaft 32 as appropriate in order to position the groove 34 substantially at the top or inner surface of the oil pan bottom wall W when the plug 30 is installed and fully seated in the oil pan drain hole H (FIGS. 12 and 13), or fundamentally the groove 34 location is based on the approximate thickness of the oil pan bottom wall W and the related configuration of its drain hole H, which again can vary depending on the commercial context. Staying with the exemplary embodiment wherein the oil pan bottom wall W is approximately 5-7 mm thick, the distance between the groove 34, or more precisely its proximal edge, and the head 38, or more precisely its bottom or distally-facing side, would then be approximately 5-7 mm as well. Ultimately, due to the location and configuration of the circumferential groove 34 and the cross-hole 36 communicating between the external circumferential groove 34 and the internal bore 44, it will be appreciated that in use even with the plug 30 retained in the oil pan drain hole H, when the plug 30 is opened by unseating the plunger 54, substantially all oil in the pan P (FIG. 9) can drain out through the bore 44 itself as well as through the groove 34, cross-hole 36, and bore 44 as described more fully herein. And due to the unique configuration of the internal bore 44 with expanded throat 48 in which the plunger 54 operates being located in the relatively wider area of the plug 30 in the vicinity of the head 38 and boss 42, the portion of the plug 30 that extends away from the oil pan P or the stand-off of the plug 30 from the bottom of the oil pan P is relatively minimal and roughly that of a standard oil plug (not shown) or approximately 8.5 mm, or less than 9 mm (i.e., the distance from the distal or back surface of the plug head 38 to the proximal or top surface of the plug boss 42). And even with the protective safety cap 70 installed on the plug 30, the stand-off is still only approximately 9.7 mm, or less than 10 mm (i.e., the distance from the distal or back surface of the plug head 38 to the proximal or top surface of the safety cap 70), which low profile as made possible by the configuration of the oil drain plug 30 according to aspects of the present invention and particularly the throat 48 within the bore 44 that allows space opposite the plug head 38 in which the valve plunger 54 can operate without such region having to extend proximally within a larger head 38 or boss 42 again has the benefit in use as not found in other such oil drain plugs of the exposed portion of the plug 30 extending a relatively minimal distance from the oil pan P and thereby being less susceptible to shearing off or other damage in the event of a collision. The male thread form on the plug threaded boss 42 and that of the corresponding female thread within the cavity 76 of the safety cap 70 may vary, but in the exemplary embodiment is a nominal 15×0.75 mm diameter and pitch, which of course corresponds as well to the internal female thread formed in the distal cavity 106 of the oil drain tool 80. Once more, other sizes and shapes or configurations of the components of the oil drain plug 30 and the overall oil evacuation system 20 are possible according to aspects of the present invention without departing from its spirit and scope.

Figure 4:
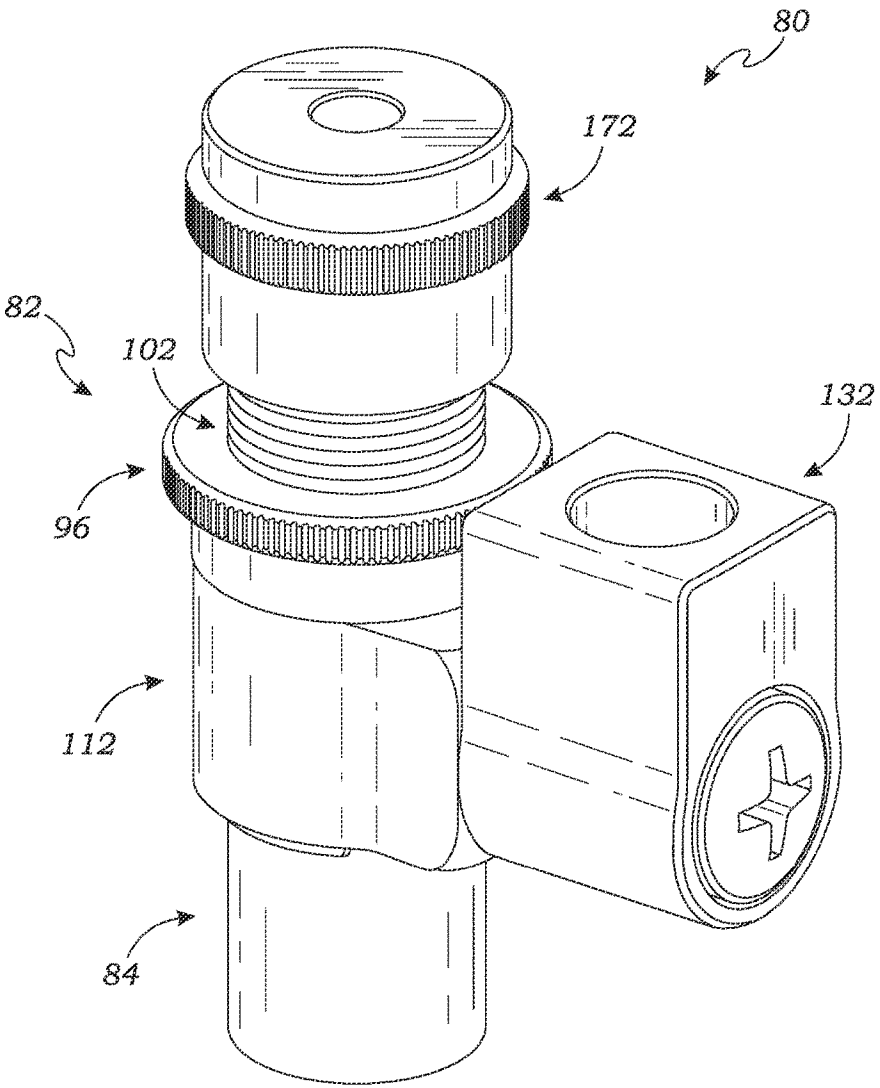
FIG. 4 is a perspective view of an exemplary oil drain tool, in accordance with at least one embodiment.
Figure 5:
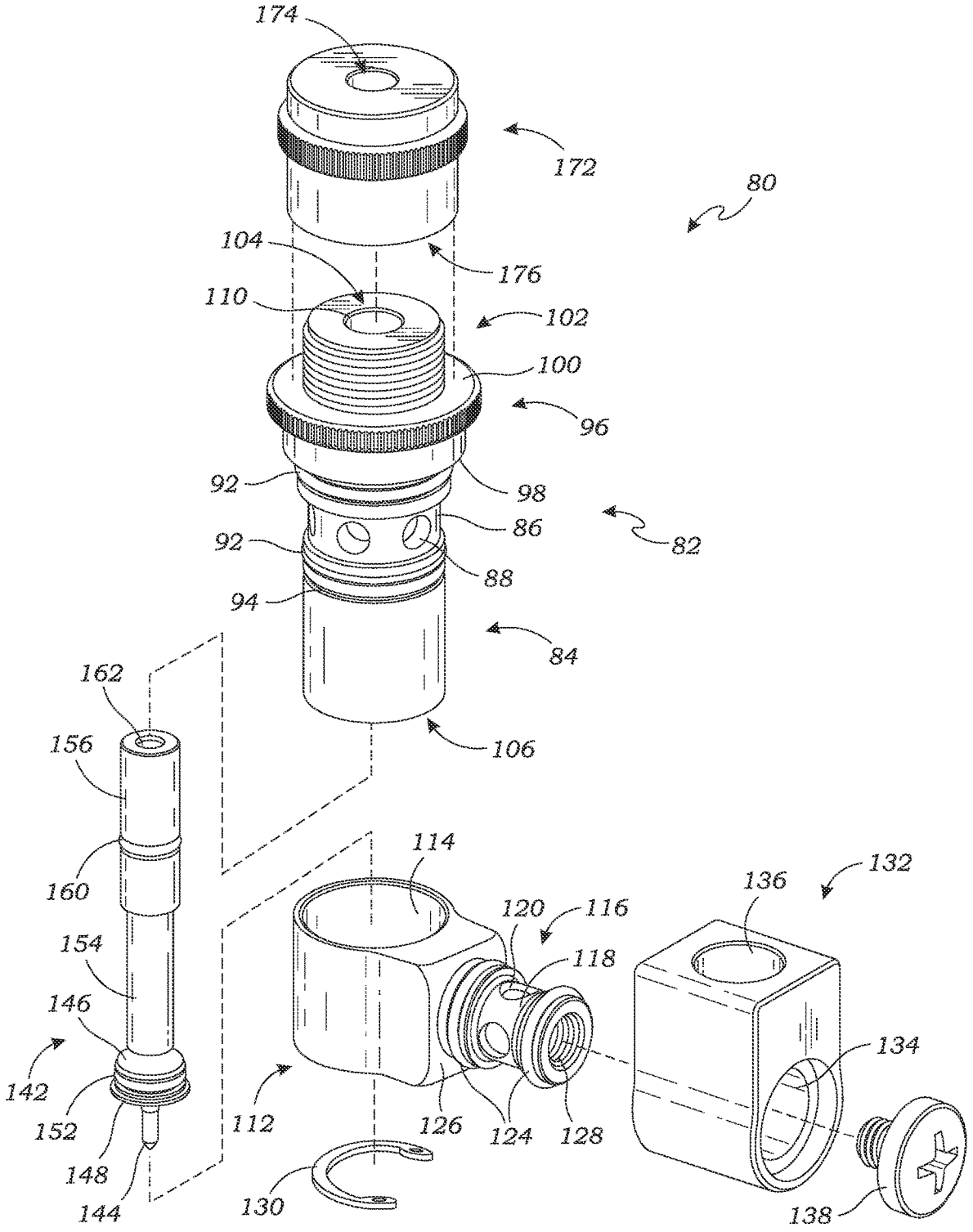
FIG. 5 is a reduced scale exploded perspective view thereof, in accordance with at least one embodiment.
Figure 6:
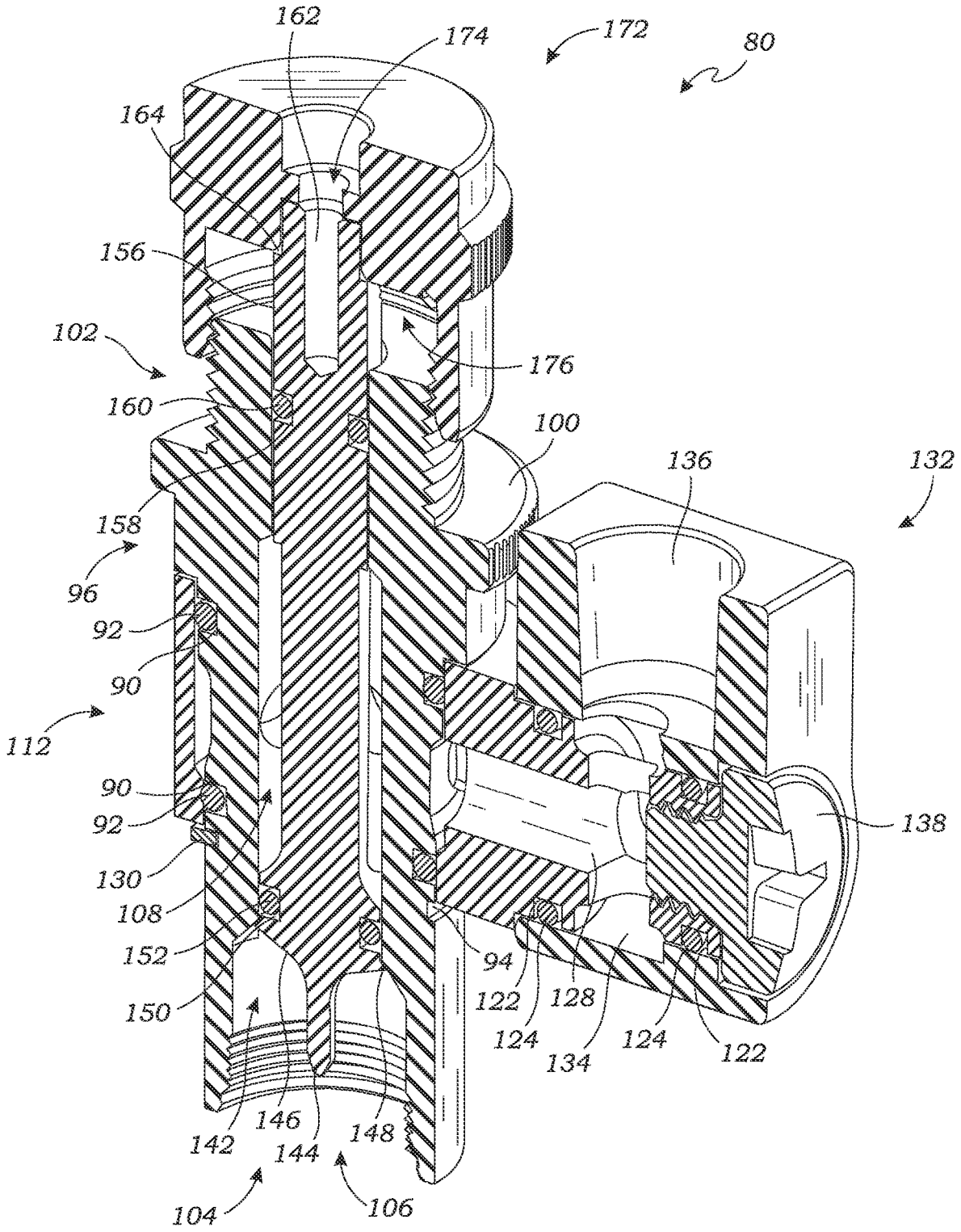
FIG. 6 is an enlarged cross-sectional perspective view thereof, in accordance with at least one embodiment.

Referring next to FIGS. 4-6, there are shown standard, exploded, and cross-sectional perspective views of an exemplary embodiment of an oil drain tool 80 according to aspects of the present invention configured for selective operational engagement with the exemplary oil drain plug 30 (FIGS. 1-3). The oil drain tool 80 generally comprises, in the exemplary embodiment, a body 82, a pair of swivel members 112, 132 operably engaged with each other and with the body 82, and an actuator 142 operably positioned within the body 82 and having a knob 172 operable with the actuator 142 as the knob 172 is operably engaged with the body 82, such components working in concert as best understood with reference to FIGS. 7 and 8 discussed further below to selectively engage and open the oil drain plug 30 so as to allow oil to flow through both the plug 30 and the tool 80 and out. The oil drain tool body 82 has a distal connector 84 in which is formed an annular relief 86 having spaced-apart cross-holes 88 formed therein. Adjacent to and distally and proximally bounding the connector relief 86 are offset connector o-ring grooves 90 having an o-ring 92 installed in each. Proximal of the connector 84 there is formed on the oil drain tool body 82 an intermediate head 96 configured as a stepped collar region defining opposite distal and proximal shoulders 98, 100 and here having a knurled surface for gripping. And proximal of the head 96 there is formed a proximal threaded boss 102. A bore 104 is formed axially along the length of the body 82 from the distal connector 84 to the proximal boss 102. Distally, the bore 104 defines a distal cavity 106 formed with internal female threads configured for selective engagement with the boss 42 of the oil drain plug 30 (FIGS. 1-3), more about which is said below in connection with both FIGS. 7 and 8 and FIGS. 9-14 illustrating the 20) oil evacuation system 20 in use. The bore 104 is further configured with or defines a relatively smaller intermediate bore relief 108 and then a still relatively smaller proximal through-hole 110. Notably, the connector cross-holes 88 formed in the connector relief 86 intersect the bore 104 in the region of the intermediate bore relief 108 and thus allow for fluid communication between the exterior connector relief 86 and the interior bore relief 108. Exteriorly, the first swivel member 112 being formed with a first swivel bore 114 slides over the connector 84 until it seats against the distal shoulder 98 of the head 96 and thus spans the connector relief 86 with the opposite connector o-rings 92 sealing distally and proximally about the connector relief 86 between the connector 84 and the first swivel member 112, which can thus rotate or pivot three-hundred-sixty degrees (360°) about the connector 84, retained thereon by a retaining ring 130 seated within an undercut 94 formed in the connector 84 distal of the connector relief 86 and the distal connector o-ring 92. A laterally-projecting swivel post 116 is formed so as to extend from the first swivel member 112 and with an axial post bore 128 intersecting and in fluid communication with the first swivel bore 114. The swivel post 116 is further formed having an exterior post relief 118 having one or more post cross-holes 120 formed therein so as to intersect and be in fluid communication with the post bore 128 and bounded by offset post o-ring grooves 122 having a post o-ring 124 seated in each. Accordingly, the second swivel member 132 being formed with a second swivel bore 134 slides over the first swivel member post 116 until the second swivel member 132 seats against the post shoulder 126 formed at the base of the post 116 and thus spans the post relief 118 with the opposite post o-rings 124 sealing about the post relief 118 between the post 116 of the first swivel member 112 and the bore 134 of the second swivel member 132, which can thus rotate or pivot three-hundred-sixty degrees (360°) about the first swivel member post 116, retained thereon here by a screw-type fastener 138 that threadably engages the free end of the post bore 128 through the second swivel bore 134. Finally, a second swivel through-hole 136 is formed in the second swivel member 132 so as to intersect and be in fluid communication with the second swivel bore 134 and thus the first swivel member post bore 128 via the post relief 118 and post cross-holes 120 so as to thereby complete the sealed flow path from the connector bore 84 into the post bore 128 via the connector cross-holes 88 and connector relief 86. Any appropriate threaded or quick-connect fluid connector C and related fluid line L (FIG. 14) may be operably engaged with the second swivel member 132 and the second swivel through-hole 136 specifically in order to evacuate oil through the oil drain tool 80 during operation, as shown and described further below with reference to FIG. 14. With continued reference to FIGS. 4-6, the elongate actuator 142 is slidably and rotatably installed within the connector bore 104 so as to selectively allow or block a fluid flow path therethrough. As shown, the actuator 142 is formed having an intermediate actuator relief 154 bounded distally by a collar 146 having a distal o-ring groove 150 with a distal o-ring 152 therein and proximally by a shank 156 having a proximal o-ring groove 158 with a proximal o-ring 160 therein, the distal collar 146 and o-ring 152 configured to ride in and seat and seal against the connector bore 104 in the distal region of the bore relief 108 and the proximal shank 156 and o-ring 160 configured to ride in and seat and seal against the proximal through-hole 110 of the connector bore 104, the distal and/or proximal actuator o-rings 152, 160 thereby selectively sealingly bounding the fluid interface between the central bore relief 108 and the central actuator relief 154, more about which is again said below in connection with FIGS. 7 and 8. Notably, formed along the distal circumferential edge of the actuator collar 146 is a relatively larger diameter actuator collar flange 148 that selectively seats against the interface between the distal cavity 106 and the connector bore relief 108, thereby preventing or serving as a hard stop against further proximal travel of the actuator 142 during use. Accordingly, those skilled in the art will appreciate that in the exploded perspective view of FIG. 5, the actuator 142 is inserted in a proximal direction within the body 82 of the oil drain tool 80 from its distal end, or more precisely is inserted proximally through the connector distal cavity 106 and into the relief 108 and through-hole 110 of the connector bore 104. The actuator 142 further comprises a distally-projecting tip 144 distal of the collar 146 and configured to selectively engage the proximally-opening countersunk hole 58 in the spring-biased oil drain plug plunger 54. And oppositely, the actuator 142 is formed with its proximal shank 156 having a proximally-opening hole 162 and an optional offset proximally-facing shoulder 164, regardless such proximal end of the actuator 142 being configured for operable installation of the knob 172 for selective operation and movement of the actuator 142 during use of the oil drain tool 80. In the exemplary embodiment, the knob 172 is formed having a stepped knob bore 174 for receipt of the actuator shank 156, whether or not the knob 172 also bottoms on a shank shoulder 164, thereby aligning the knob bore 174 with the actuator hole 162 such that the knob 172 may be installed using a screw-type fastener (not shown) passing through the knob bore 174 and into threadable engagement with the actuator hole 162. The knob 172 is further formed with a distally-opening internally-threaded cavity 176 for threadable engagement with the proximally-oriented externally-threaded boss 102. It will thus be appreciated by those skilled in the art that as the knob 172 is rotated in one direction it will travel distally along the drain tool boss 102 thereby advancing the actuator 142 distally and that as the knob 172 is rotated in the opposite direction it will travel proximally along the drain tool boss 102 thereby retracting the actuator 142 proximally.

Figure 8:
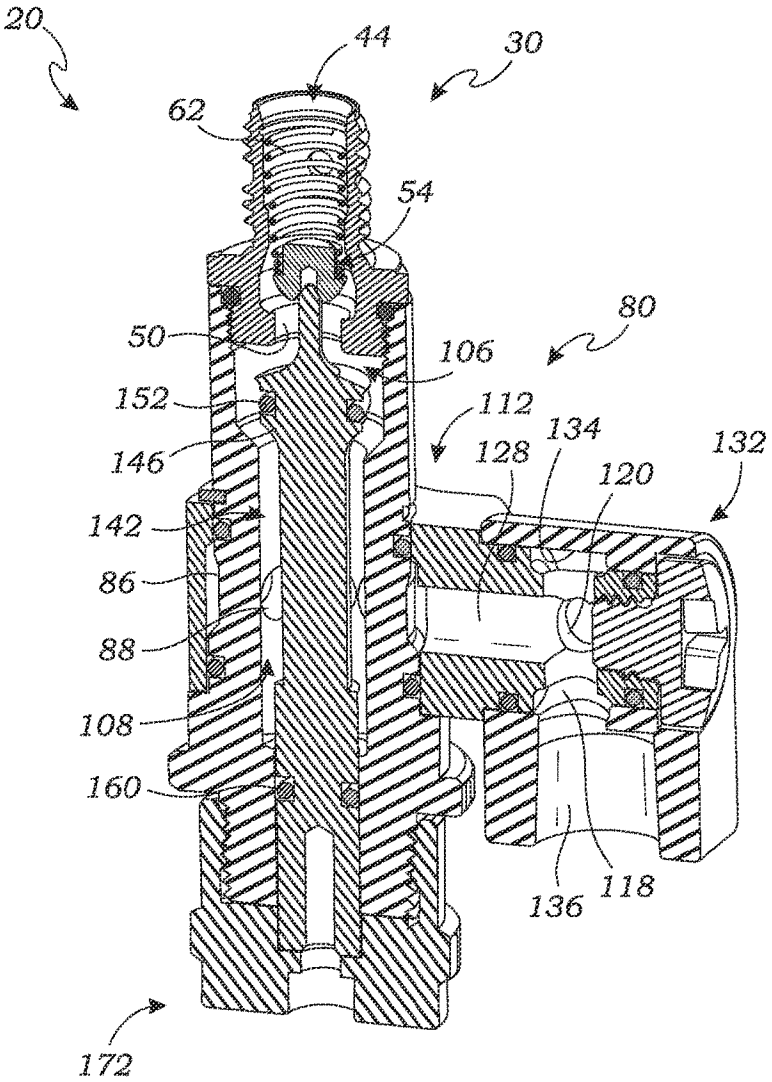
FIG. 8 is a further cross-sectional perspective view thereof in a second operational mode, in accordance with at least one embodiment.
Figure 7:
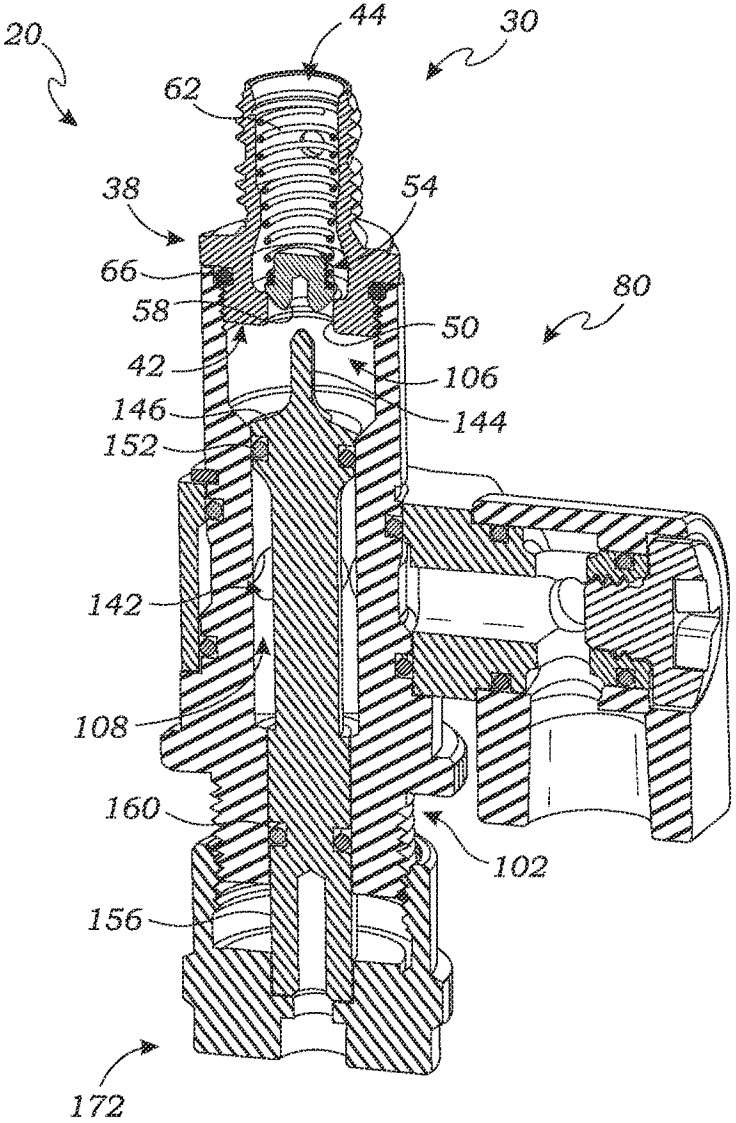
FIG. 7 is a reduced scale cross-sectional perspective view of an exemplary oil evacuation system as comprising the exemplary oil drain tool of FIGS. 4-6 installed on the exemplary oil drain plug of FIGS. 1-3 in a first operational mode, in accordance with at least one embodiment.
Figure 9:
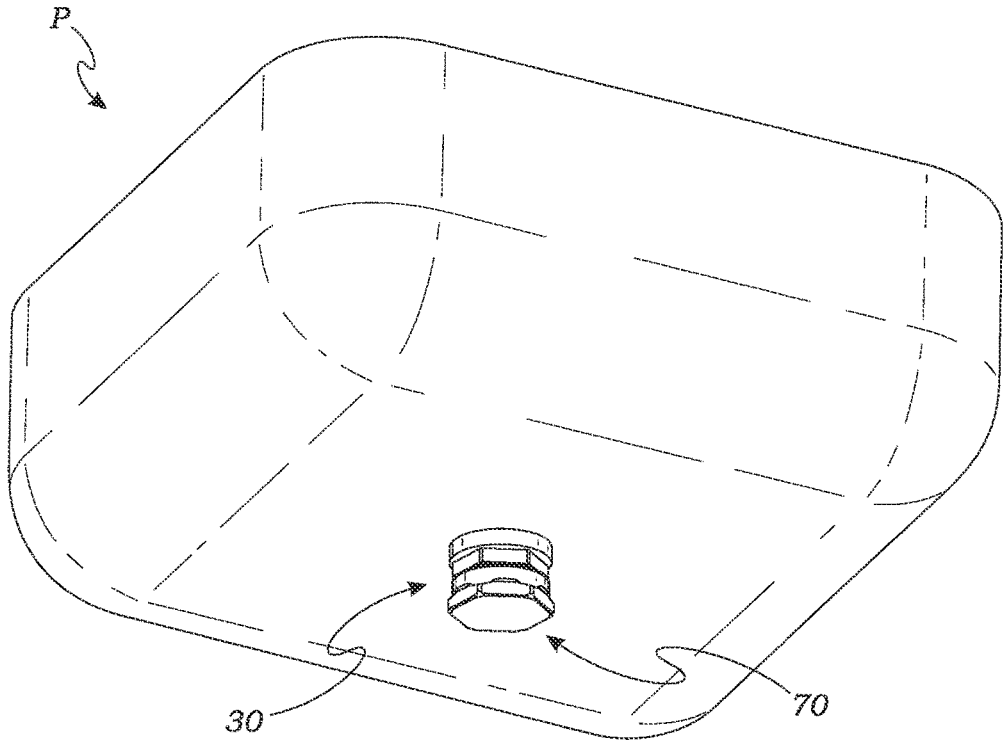
FIG. 9 is a reduced scale perspective view of the exemplary oil drain plug of FIGS. 1-3 installed in an oil pan, in accordance with at least one embodiment.

In more detail now regarding the basic operation of the oil drain plug 30 upon operable engagement by the oil drain tool 80, the two together constituting the oil evacuation system 20, attention is turned to the cross-sectional perspective views of FIGS. 7 and 8 with continued reference to FIGS. 1-6. As a threshold matter, it is first observed that both views show the plug 30 and tool 80 flipped relative to the views of FIGS. 1-6, here the parts being oriented with the distal ends up as they would typically be oriented when installed or employed in connection with an oil pan P having its drain hole H in its bottom wall W (FIGS. 9-14). In both views, the oil drain tool 80 is connected with the oil drain plug 30 as by first removing the safety cap 70 (FIGS. 1-3) from the plug boss 42 and then threadably engaging or screwing the tool 80 and particularly the threaded distal cavity 106 formed in the tool body 82 onto the oil drain plug boss 42 as shown. It is noted that the o-ring 66 at all times remains installed on the plug 30 at the shoulder or interface between the head 38 and the threaded boss 42 to facilitate sealing with either the safety cap 70 or here the oil drain tool 80, and particularly between the boss 42 and the tool connector cavity 106. As seen in FIG. 7, the oil drain tool 80 is thus operably installed on the oil drain plug 30 and ready for operation, but the plug 30 is still closed with its spring-biased plunger 54 seated against the internal edge surface 52 of the plug through-hole 50. In this first operational mode, it will be appreciated that not only is the plug 30 closed and sealed so that no oil can yet flow out of any oil pan in which the plug 30 is installed, but the flow path through the oil drain tool 80 is closed and sealed as well, as by the actuator distal and proximal o-rings 152, 160 within the tool bore 104 sealing above and below the bore relief 108, specifically the distal o-ring 152 between the actuator collar 146 and the bore relief 108 and the proximal o-ring 160 between the actuator shank 156 and the tool through-hole 110, such that no oil can flow in either direction through the tool 80. Notably, in such first operational mode, the oil drain plug 30 is thus closed and not yet actuated because the actuator 142 of the oil drain tool 80 is retracted and not yet advanced distally toward the oil drain plug 30—particularly, it will be observed that in this first operational mode the actuator tip 144 is spaced from and not yet engaged with the plug valve plunger 54, as shown, or at least not yet to the point of shifting the plunger 54 distally to unseat it and open the plug 30 to allow oil to drain. With particular reference now to FIG. 8, as the knob 172 of the oil drain tool 80 that is operably engaged with the actuator 142 is rotated, in the exemplary arrangement clockwise, the knob 172 will travel distally along the threaded boss 102 at the proximal end of the tool body 82 thus advancing the actuator 142 distally relative to the rest of the oil drain tool 80 and toward the oil drain plug 30. Continued rotation of the knob 172 causes continued distal advancement of the actuator 142 until the distal tip 144 of the actuator 142 seats within the countersunk hole 58 of the plug valve plunger 54. And still further rotation of the knob 172 and distal advancement of the actuator 142 will thus cause the valve plunger 54 to shift distally against the biasing spring 62 and unseat from the plug through-hole 50, thereby opening the oil drain plug 30 and allowing oil to flow therethrough. Notably, as the actuator 142 is advanced distally to the point of unseating the plunger 54 and opening the plug 30, the distal collar 146 of the actuator 142 is shifted clear of and thus it and the distal o-ring 152 are unseated from the tool bore relief 108 thereby opening the drain tool 80 also, even while the proximal o-ring 160 remains seated between the actuator shank 156 and the tool through-hole 110 to continue to seal off the back or proximal end of the tool 80 in all uses or modes of operation, including when the drain tool 80 is otherwise open. Those skilled in the art will appreciate that there is thus upon actuation of the tool 80 and the resulting opening of the plug 30 selectively formed a continuous and sealed flow path from and through the oil drain plug 30 to, through, and out of the oil drain tool 80, including its first and second swivel members 112, 132. Particularly, in the second operational mode of the oil evacuation system 20 as illustrated in FIG. 8, oil O from an oil pan P (FIGS. 9-14) can flow through the bore 44 of the oil drain plug 30, whether directly into the bore 44 at its distal opening or through its circumferential groove 34 and cross-hole 36 communicating with the bore 44, down or proximally through the bore 44 around the spring 62 and the unseated plunger 54 between it and the through-hole 50 and then out of the plug bore 44 and into and through the tool distal cavity 106 about the distal end of the actuator 142 including its unseated collar 146, into the tool bore relief 108, through the connector cross-holes 88 and into the connector relief 86 on the exterior of the tool body 82 opposite the tool bore relief 108, into and through the first swivel member post bore 128, through the post cross-holes 120 and into the post relief 118, and then into the second swivel member bore 134 and finally out of the second swivel member through-hole 136. When the oil O has finished draining through the plug 30 and tool 80 as described or such operation is otherwise concluded, and whether based on gravity feed or vacuum, the tool 80 and plug 30 can again be closed by simply rotating the knob 172 oppositely, or here counterclockwise, to retract the actuator 142 or shift it proximally. It will be appreciated that at some intermediate point between the illustrated first and second operational modes of FIGS. 7 and 8, the actuator 142, and thus its distal tip 144 and the plunger 54 engaged therewith, will travel proximally, the plunger 54 still under the biasing effect of the spring 62, until the plunger 54 again seats against the internal edge surface 52 of the plug through-hole 50 to again close the plug 30, meanwhile the distal collar 146 and o-ring 152 of the actuator 142 as they also travel or shift proximally relative to the rest of the tool 80 again seat within the tool bore relief 80 to again close the tool 80, with further proximal movement of the actuator 142 then disengaging the distal actuator tip 144 from the valve plug plunger 54 as limited by the distal flange 148 formed on the collar 146 and configured to seat against the interface between the distal cavity 106 and the connector bore relief 108 of the tool body 82, thereby preventing or serving as a hard stop against further proximal travel of the actuator 142 during use as illustrated in FIG. 7 and as also seen particularly in FIG. 6. As such, upon the closing of the oil drain plug 30 and tool 80, any residual oil is either trapped within the plug 30 behind or above the plunger 54 or within the tool 80 behind or below the actuator distal collar 146 and o-ring 152. Relatedly, in some exemplary embodiments the configurations of the oil drain plug 30 and oil drain tool 80 or the geometric arrangement of each is such that they open and close substantially simultaneously while in other exemplary embodiments it may be that one opens or closes prior to the other. By way of further illustration and not limitation, in an exemplary embodiment the geometry of the parts of the system 20 is such that upon actuation of the oil drain tool 80 as by advancement of the actuator 142, the plunger 54 of the oil drain plug 30 opens after the distal actuator o-ring 152 unseats and the tool 80 opens, whereby in reverse upon retraction of the actuator 142, the plunger 54 of the oil drain plug 30 closes before the distal actuator o-ring 152 re-seats and the tool 80 again closes, such that continued gravity feed or suction will further ensure that no residual oil remains in the tool distal cavity 106 above the then-seated actuator collar 146 as the tool 80 is disconnected from the oil drain plug 30.

In forming the oil drain plug 30 and safety cap 70 as well as the oil drain tool 80, and the various components thereof, it will be appreciated that any appropriate materials and methods of construction now known or later developed may be employed, including but not limited to metals and metal alloys such as iron, steel, aluminum, brass, nickel, and the like and potentially even a variety of temperature- and corrosion-resistant plastics such as polytetrafluoroethylene ("PTFE"), polyether ether ketone ("PEEK"), polyetherimide ("PEI"), polyamide-imide ("PAI"), polybenzimidazole ("PBI"), polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, and other such plastics, thermoplastics, thermosetting polymers, and the like, any such components being fabricated or formed as through machining, casting, extrusion, stamping, forming, injection molding, or any other such technique now known or later developed. Relatedly, such components may be formed integrally or may be formed separately and then assembled in any appropriate secondary operation employing any assembly technique now known or later developed, including but not limited to fastening, as through screws or the like, bonding, welding, press-fitting, snapping, over-molding or coining, or any other such technique now known or later developed. Those skilled in the art will fundamentally appreciate that any such materials and methods of construction are encompassed within the scope of the invention, any exemplary materials and methods in connection with any and all embodiments thus being illustrative and non-limiting. In the exemplary embodiment, the oil drain plug 30 is formed integrally in a machining operation from pre-heat-treated 17-4 steel, the safety cap 70 is formed integrally in a machining operation from 6061 aluminum and optionally anodized in a secondary operation (e.g., type 2 anodizing), and the internal plunger 54 is formed integrally in a machining operation from 360 brass, it being appreciated particularly as to the safety cap 70 being exposed during use that by forming it of a non-ferrous metal or other material such as aluminum the risk of sparking should it come in contact with other structure is again mitigated. The biasing coil spring 62 is formed from piano wire and rated at a pressure or force of 750 to 800 grams at its installed height, with the length, diameter, and number of coils of the spring 62 varying based on a number of factors including the geometry of the plug 30 itself that may also vary depending on the commercial context as set forth above (in the exemplary embodiment, the spring 62 has seven coils, not including the closed ends, over a free length of 1.0 in. and an installed length of 0.7 in. and has a proximal outside diameter nominally of 0.25 in. and a distal outside diameter nominally of 0.3125"). And finally, the o-ring 66 installed on the oil drain plug 30 as well as the o-rings 92, 124 employed with the swivel connections 112, 132 and the distal and proximal o-rings 152, 160 employed on the actuator 142 of the oil drain tool 80 are formed from temperature- and corrosion-resistant Viton® or other fluoroelastomer polymer ("FKM") rubber. Those skilled in the art will again appreciate that a variety of configurations and materials of construction, whether now known or later developed, are possible according to aspects of the present invention, such that any particular materials employed in the oil evacuation system 20 and its various components and assemblies are to be understood as illustrative and non-limiting.

Turning now to FIGS. 9-14, there is illustrated an oil evacuation system 20 according to aspects of the present invention as shown and described in connection with FIGS. 1-8 here in use in retaining oil O within or draining oil O from an oil pan P. First, in the bottom perspective view of FIG. 9 and the related top cross-sectional perspective view of FIG. 10, there are shown the oil drain plug 30 installed in a threaded drain hole H formed in the bottom wall W of an oil pan P in thereby retaining any oil O within the oil pan P (no oil O is shown in the oil pan P in FIGS. 10, 12 and 13 for clarity). As will be appreciated from the foregoing description of the configuration and operation of the oil drain plug 30, with no oil drain tool 80 (FIGS. 11-14) yet connected to the oil drain plug 30 and actuated, the plug 30 remains closed as through its internal spring-biased valve plunger 54 (FIGS. 2 and 3), which alone serves to prevent an oil leak from the oil pan P. Furthermore, the safety cap 70 is threadably installed on the plug 30 when it is not to be activated to drain the oil, seating against the o-ring 66 (FIGS. 1-3) to not only retain the cap 70 in place on the plug 30 when the plug 30 is not to be accessed and the related vehicle (not shown) is in normal use or operation but to also provide a secondary seal of the oil drain plug 30 should for some reason the internal valve plunger 54 not seat or seal properly or otherwise fail such as by the spring 62 or the retaining ring 64 securing the spring 62 failing. As noted above, in one exemplary commercial context, the oil drain plug 30 is torqued to 28 N-m within the oil pan drain hole H and the safety cap 70 is torqued to 60 cN-m on the oil drain plug 30. In testing such an exemplary drain plug 30 and safety cap 70 in use, it was found that the plug 30 withstood over one hundred torque cycles to 28 N-m without issue and did not fail at even up to about to 55 N-m of torque, the threaded hole H in the aluminum oil pan P stripping instead. Once installed, the drain plug 30 alone without the safety cap 70 was pressure tested to over 150 psi without failure. And though not typical use but instead to simulate a failure of the internal plunger 54 of the valve plug 30, it was also pressure tested without the plunger 54 installed and just the safety cap 70 threadably installed to a torque of 60 cN-m against the o-ring 66 (FIGS. 1-3) of the plug 30, and it was found that the cap 70 as a secondary seal itself withstood a pressure of over 150 psi as well. Further, the installed plug 30 alone was tested under vacuum to simulate crank case vacuum, in the event the safety cap 70 was accidentally left off of the drain plug 30, and the plug 30 held over 28 inHg vacuum, far exceeding the typical 1-2 inHg crank case vacuum pressure. Dimensionally, it is once again noted that the stand-off of the drain plug 30 with cap 70 from the bottom wall W of the oil pan P, or more precisely the bottom surface of any drain hole boss B, is approximately 10 mm, or little more than that of a standard drain plug (not shown). And once again, the safety cap 70 being aluminum in the exemplary embodiment, it will be appreciated that it will not spark when contacting other components or structures, such as in a collision and that it may be anodized clear or red or blue or other color for better visibility as well as potentially be marked with safety or instructional information, for example, regarding what it should be torqued to, such as 60 cN-m.

Figure 11:
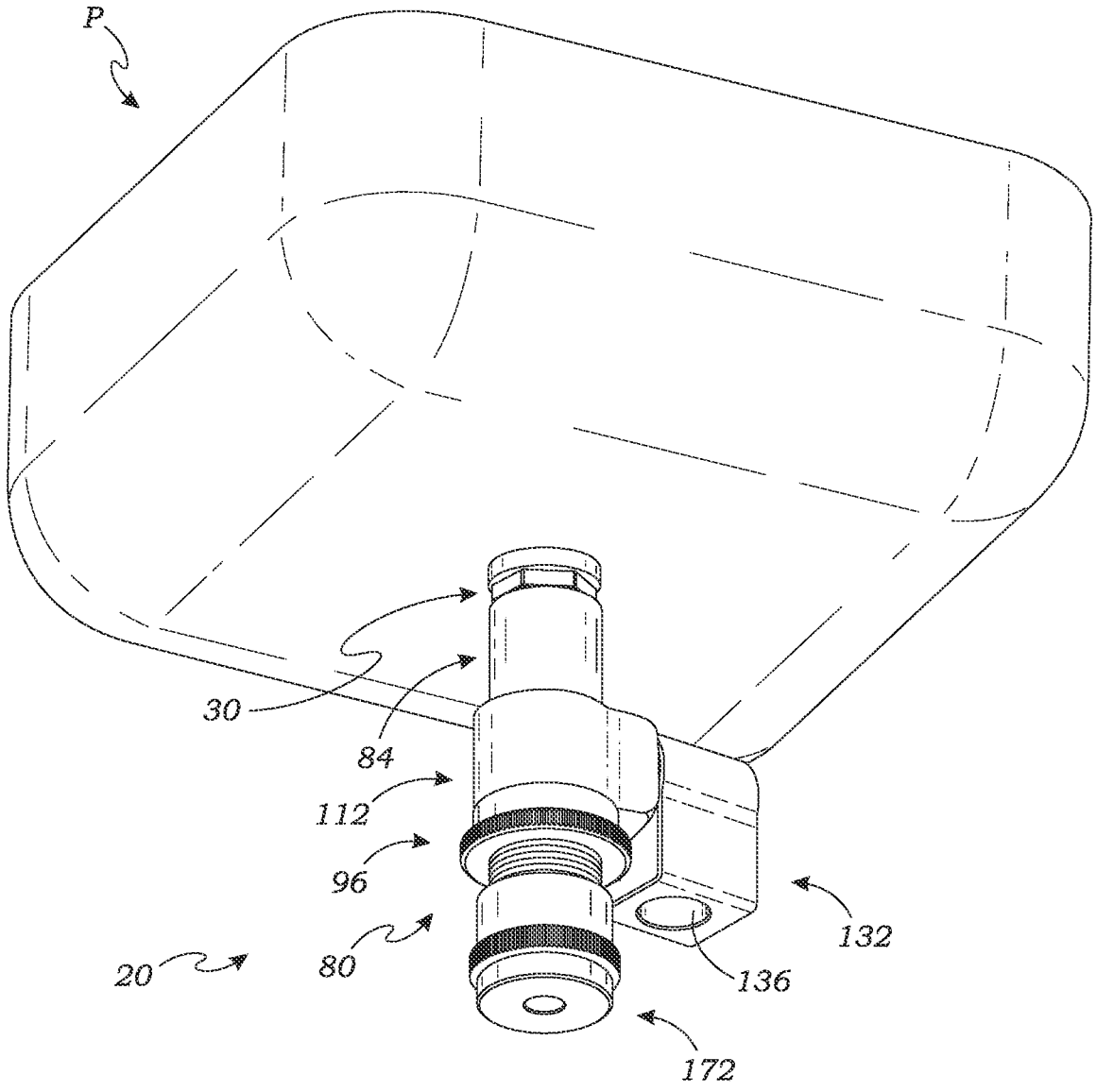
FIG. 11 is a reduced scale perspective view of the exemplary oil evacuation system of FIG. 7 wherein the oil drain plug of FIGS. 1-3 is installed in an oil pan and the exemplary oil drain tool of FIGS. 4-6 is installed on the oil drain plug, in accordance with at least one embodiment.
Figure 14:
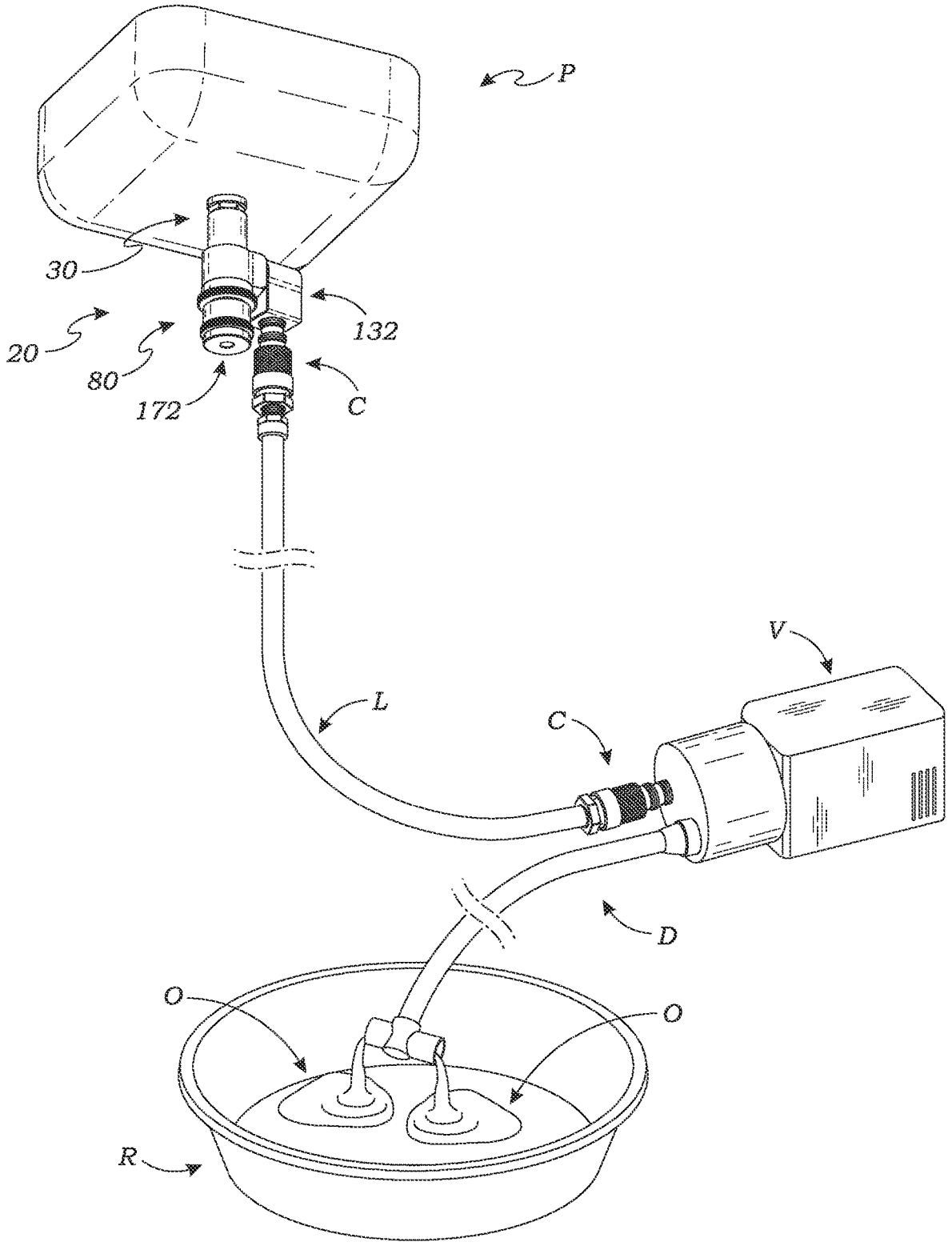
FIG. 14 is a perspective view thereof in operation with a drain line connected between the exemplary oil drain tool and an evacuation pump, in accordance with at least one embodiment.

Turning to FIG. 11, when oil is to be drained from the pan P, the safety cap 70 is removed and the drain tool 80 is threadably installed on the plug 30 and specifically the tool connector 84 onto the plug boss 42 until hand tight against the plug o-ring 66 as by grasping and rotating the drain tool head 96 that is integral with the tool connector 84 as being part of the common tool body 82 (FIG. 5). In the installed position as shown, it will be appreciated that the first swivel member 112 can freely rotate 360° around or relative to the tool connector 84 and in a perpendicular plane the second swivel member 132 can freely rotate 360° around or relative to the first swivel member 112, thereby providing tremendous flexibility and virtually infinite positioning of the tool fluid outlet 136 relative to the oil pan drain hole H to address any interference or room or access constraints from surrounding structure or in contexts where the drain hole is in a side wall rather than the bottom wall of the oil pan. And as shown in FIG. 14, any quick-connect or other connector C can be installed in or in conjunction with any mating parts in the second swivel through-hole or outlet 136 for directing the oil flowing out of the oil pan P when the valve plug 30 is opened, again whether under vacuum or based on gravity feed. For example, though not shown, a male barb fitting or quick-connect fitting can be threadably installed in the outlet hole 136 of the second swivel member 132 of the oil drain tool 80 to facilitate quick and easy connection to and disconnection from the tool 80 by a drain line L.

Figure 10:
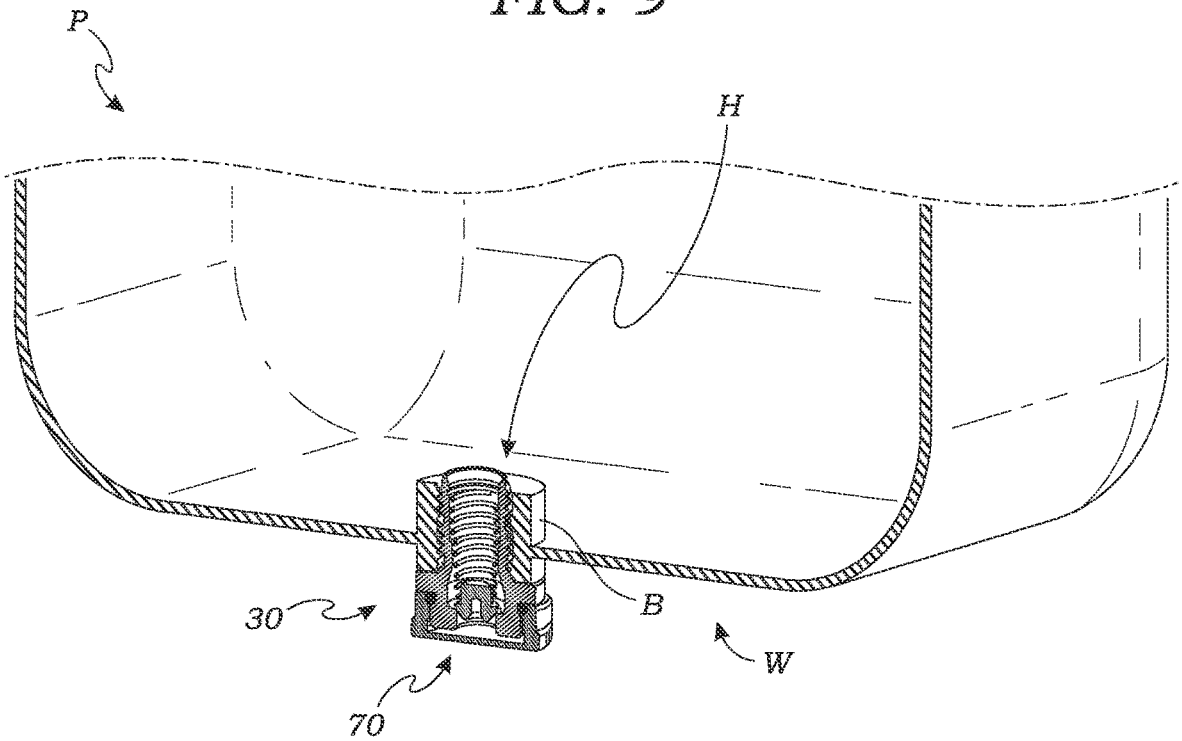
FIG. 10 is an enlarged cross-sectional perspective view thereof, in accordance with at least one embodiment.
Figure 12:
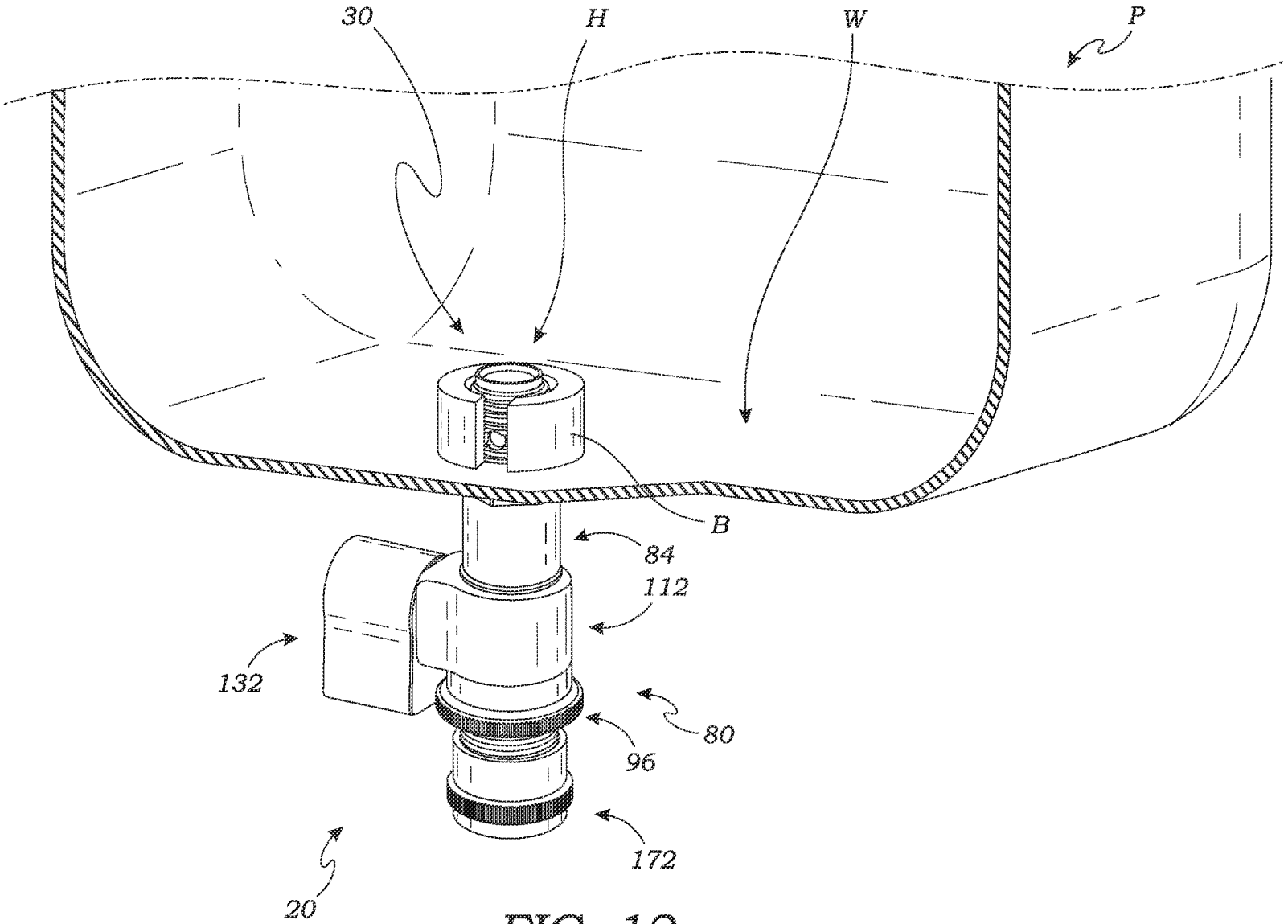
FIG. 12 is an enlarged cut-away perspective view thereof, in accordance with at least one embodiment.
Figure 13:
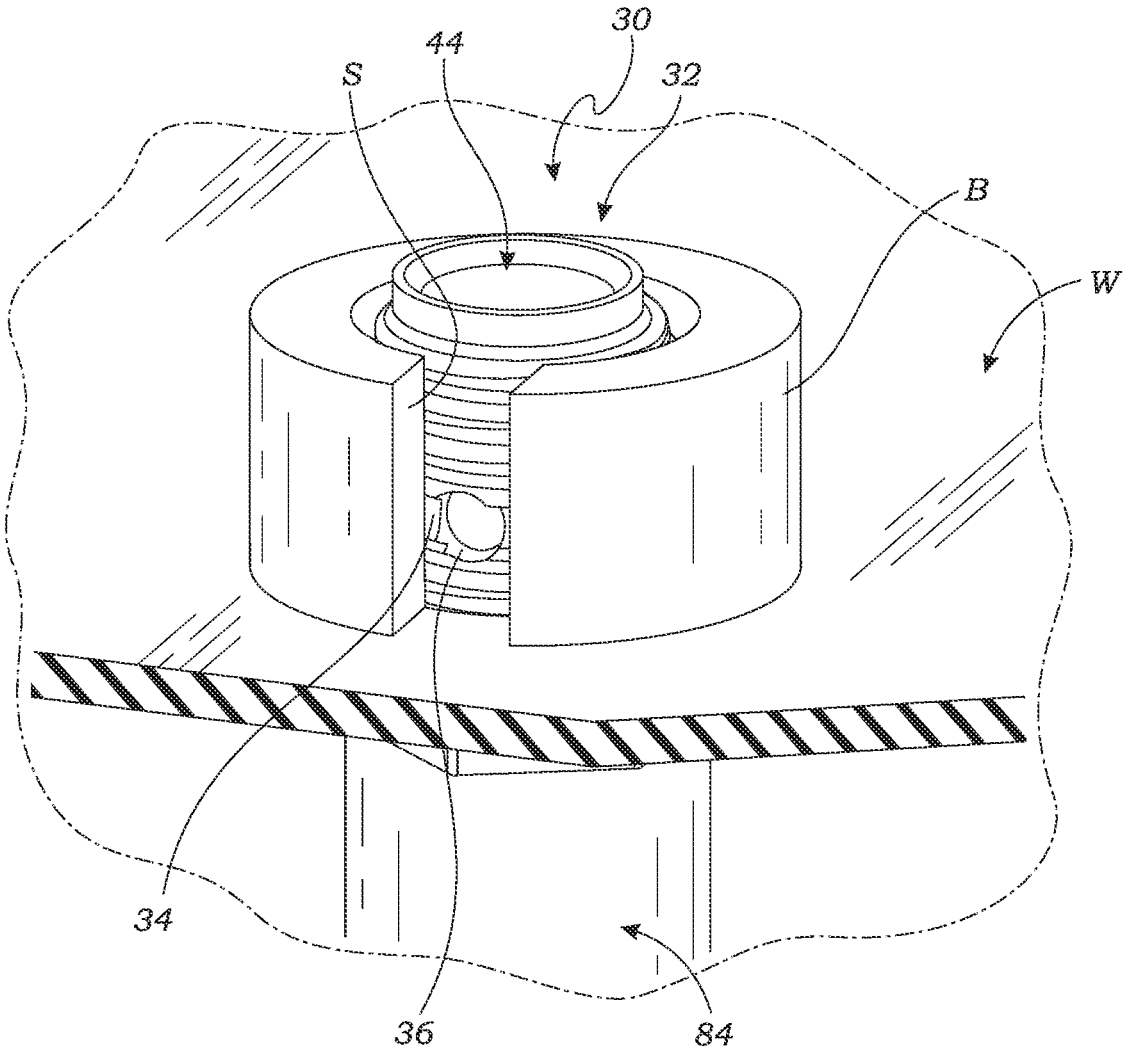
FIG. 13 is a further enlarged cut-away perspective view thereof, in accordance with at least one embodiment.

Referring next to FIGS. 12 and 13 showing cutaway views of the oil pan P with the oil evacuation system 20 operably installed therewith, as by again having the oil drain plug threadably installed in the oil pan drain hole H and the oil drain tool 80 threadably installed on the plug 30, it can be seen, as in FIG. 10, that in the illustrated oil pan P the threaded boss B in which the oil drain plug 30 is threadably installed extends upwardly or inwardly within the oil pan P effectively to provide sufficient material in which the plug 30 can engage relative to the thinner wall W of the oil pan P and preferring to have the plug 30 as flush as possible with the bottom or outer surface of the bottom wall W of the oil pan P so as to have a relatively low profile or exposed portion. To then still allow for drainage from the oil pan P of substantially all oil O, the boss B is formed with a vertical channel or slot S running the vertical length of the boss B within the oil pan P, such that oil O can run out of the pan P through the slot S and thus through the drain hole H all the way down to the inner surface of the bottom wall W. This of course works as intended when the standard oil drain plug (not shown) is removed each time the oil is to be drained. But as here where a new and improved oil drain plug 30 is to remain in the oil pan hole H even when the oil O is to be drained, such plug 30 would block the slot S in the boss B and thus allow drainage only down to the top or distal end of the plug 30 and prevent drainage from the top end of the plug 30 down to the bottom wall W of the pan P, were it not for the clever groove 34 and cross-hole 36 formed in the plug shaft 32 so as to allow fluid to pass into the plug bore 44 at a location proximal of or below the distal end or bore opening of the drain plug 30. Again, as shown particularly in FIGS. 1-3, a circumferential groove 34 is formed at an intermediate location eternally about the threaded shaft 32 of the plug 30 with a cross-hole 36 formed therein so as to intersect the groove 34 as well as the internal bore 44 of the plug 30 and thus provide for fluid communication between the groove 34 and bore 44. It will be appreciated by those skilled in the art that it follows that even with the plug 30 still installed within the oil pan drain hole H as shown, oil O entering the slot S can pass into the groove 34 and through the cross-hole 36 into the internal plug bore 44 and then through and out of the plug 30 just as oil entering the bore 44 from its distal open end. It will be further appreciated that with the groove 34 being circumferential or about the full perimeter of the plug shaft 32, the groove 34 thus provides an annular relief about the shaft 32 or between the shaft 32 and the inside surface of the boss B that oil O can flow into from the slot S regardless of the rotational position of the plug shaft 32 and particularly the one cross-hole 36 relative to the boss slot S. Accordingly, while for simplicity the plug shaft 32 is shown as positioned within the oil pan boss B such that the cross-hole 36 is somewhat aligned with the slot S, such is not necessary for the proper operation of the oil drain plug 30 in allowing for substantially all of the oil O to be drained. Being so operable even with one cross-hole 36 has the further advantage of not unnecessarily weakening the plug shaft 32 by having multiple cross-holes intersecting the groove 34. In terms of the vertical position of the groove 34 and cross-hole 36 along the plug shaft 32, those skilled in the art will again appreciate that such may be located along the shaft 32 as appropriate in order to position the groove 34 substantially at the top or inner surface of the oil pan bottom wall W when the plug 30 is installed and fully seated in the oil pan drain hole H, or fundamentally the groove 34 location is based on the approximate thickness of the oil pan bottom wall W and the related configuration of its drain hole H and thus can vary to suit different commercial contexts. As such, the exemplary location of the groove 34 and cross-hole 36 is to be understood as illustrative and non-limiting, with other geometric arrangements expressly coming within the spirit and scope of aspects of the present invention.

Finally, turning to FIG. 14 illustrating the exemplary oil evacuation system 20 according to aspects of the present invention in use in draining oil O from an oil pan P, it is first again observed that a connector C with drain line L is fluidly connected to the second swivel member 132 of the oil drain tool 80 as herein described as employing any appropriate parts now known or later developed, whether before or after the tool 80 is installed on the drain plug 30. In such condition, the tool 80 and plug 30 are ready to drain the oil O but both the plug 30 and the tool 80 are still closed, the system 20 basically being in the first operational mode as shown and described in FIG. 7 with the knob 172 and thus the internal actuator 142 retracted or positioned or shifted proximally. To proceed with the operation to drain the oil O, the knob 172 is then rotated, in this example clockwise, to shift the knob 172 and thus the internal actuator 142 up or distally to activate or open the plug 30 as well as the tool 80 as in the second operational mode shown and described in FIG. 8, thereby configuring the system 20 for oil drainage. Such drainage may again be by gravity as by simply running the free end of the drain line L into a receptacle R or other such collection container. Or as shown, at the end of the drain line L opposite the tool 80, a second quick-connect or other connector C may be operably installed for fluid connection at the inlet side of a vacuum pump V. Turning on the vacuum pump V will thus pull or suck oil O out of the oil pan P through the opened oil drain plug 30 and tool 80 and the drain line L, with the free end of a discharge line D from the outlet side of the vacuum pump V then positioned to allow the oil O to flow into a receptacle R or other such container. After substantially all oil O has been drained from the oil pan P, which can take different amounts of time depending on a number of factors such as the amount and viscosity of the oil (i.e., type of oil and ambient temperature) and the power or vacuum or suction pressure of the pump V, the foregoing steps are effectively just performed in the same order—the knob 172 is rotated oppositely, or here counter-clockwise, to again retract the internal actuator 142 within the tool 80 and thereby close both the tool 80 and the drain plug 30 as herein described, thereby shifting the system 20 from the "open" second operational mode illustrated in FIG. 8 back to the "closed" first operational mode of FIG. 7. At that point the vacuum pump V is switched off and the drain line L disconnected from the tool 80 and/or the tool 80 disconnected from the plug 30. As an aside, it will be appreciated that as a further benefit of the swivel assembly of the tool 80, and particularly the free rotation of the first swivel member 112 about the tool connector 84, the tool connector 84 can thus be rotated so as to unscrew it from the drain plug 30 even while the first swivel member 112 and thus the second swivel member 132, connector C, and drain line L can remain connected and substantially in the same position spatially, thereby allowing for convenient removal of the tool 80 from the plug 30 even while the tool 80 remains connected to the drain line L. Conveniently, the entire oil drain process can thus be performed with no mess or spills or having to deal with removing and replacing a conventional oil drain plug each time. Indeed, not only is the valve plug 30 closed and no oil flowing when the safety cap 70 is removed and the oil drain tool 80 threadably engaged with the plug 30 at the start of the process and thus no oil splashing on the hand of the operator or on any under-panel features such as a stiffening plate or other structure, but both the plug 30 and tool 80 are again closed prior to their disconnection at the end of the process so that no oil drips or leaks occur. And in the illustrated embodiment, leaving the vacuum pump V on as the tool 80 and plug 30 are again closed further ensures that all residual oil O within the system 20 is pulled into the line L and out and thus behind the sealed regions particularly of the tool 80. As such, once the oil drainage process is completed and the tool 80 is disconnected from the oil drain plug 30, the safety cap 70 is again simply screwed onto the plug 30 and the vehicle (not shown) is ready for fresh oil to be added and to be operated as normal.

Aspects of the present specification may also be described as follows:

1. An oil evacuation system for draining oil from an oil pan having a drain hole, the system comprising: an oil drain plug having a distal threaded plug shaft, an intermediate plug head, and a proximal threaded plug boss, the plug shaft configured to threadably engage the oil pan drain hole, the plug further having an axial plug bore therealong, the plug bore having formed therein proximally a relatively larger diameter throat opposite the plug head, the plug further having a plunger positioned within the throat and configured to selectively seal the plug bore under the biasing effect of a spring extending distally from the plunger; a safety cap configured for selective threadable engagement with the plug boss for selectively proximally covering the plug; and an oil drain tool configured for selective operable installation on the plug upon removal of the cap when the plug is installed in the drain hole and oil is to be drained from the oil pan, the tool comprising a body having a distal threaded connector and a proximal threaded tool boss, the connector configured to threadably engage the plug boss, the tool further having an axial tool bore therealong, the tool bore having a distal cavity defining the threaded connector and a relatively smaller diameter intermediate bore relief, the tool further having an actuator slidably and selectively sealingly installed within the tool bore and configured for selective engagement with the plunger; wherein the stand-off of the plug from the plug head to the plug boss is less than nine millimeters (9 mm) and with the cap installed on the plug boss is less than ten millimeters (10 mm), whereby the plug has a relatively low profile when installed in the drain hole of the oil pan; and wherein during use when the plug is installed in the drain hole and oil is to be drained from the oil pan, upon removal of the cap from the plug and threadable installation of the tool on the plug, actuation of the actuator of the tool causes the actuator to engage and unseat the plunger of the plug within the plug bore and thereby allow the flow of oil through the plug around the plunger and through the tool around the actuator.

2. The system of embodiment 1 wherein the plug shaft is formed with an exterior circumferential groove thereabout and a cross-hole communicating between the groove and the plug bore, thereby allowing for fluid flow from the exterior of the plug shaft into the plug bore.

3. The system of embodiment 2 wherein the distance of the groove from the plug head corresponds to the thickness of a wall of the oil pan in which is formed the drain hole in which the plug may be selectively installed, whereby oil may drain through the groove and the cross-hole and out of the oil pan through the plug bore substantially down to the wall.

4. The system of any of embodiments 1-3 wherein the plug bore is formed with a through-hole proximal of and relatively smaller than the throat, an edge surface thereby being defined between the through-hole and the throat, whereby the plunger selectively seats and seals against the edge surface.

5. The system of embodiment 4 wherein the plunger is formed having a domed proximally-facing plunger surface configured for seating and sealing against the edge surface.

6. The system of any of embodiments 1-5 wherein the plunger is formed with a distally-facing plunger shoulder configured for proximal retention of the spring.

7. The system of any of embodiments 1-6 wherein the plug bore is formed distally having an undercut and a plug retaining ring is installed in the undercut for retention of the spring opposite the plunger.

8. The system of any of embodiments 1-7 wherein an axial proximally-opening countersunk hole is formed in the plunger and configured for selective receipt of a distal tip of the actuator in selectively engaging and unseating the plunger within the plug bore, the distal tip of the actuator accessing the countersunk hole of the plunger through the plug through-hole.

9. The system of any of embodiments 1-8 further comprising an o-ring seated on the plug boss adjacent to the plug head and configured for sealingly engaging the cap or the connector of the tool in use, whereby the o-ring forms a seal with and helps retain the cap and the connector on the plug.

10. The system of any of embodiments 1-9 wherein the actuator is formed with a distal collar proximal of the distal tip, the collar configured for selectively sliding within the bore relief of the tool bore.

11. The system of embodiment 10 wherein the collar is formed with an outwardly-opening distal o-ring groove having a distal o-ring seated therein for slidably and sealingly engaging between the collar and the bore relief for selectively sealing the tool distally.

12. The system of embodiment 10 or embodiment 11 wherein the collar is formed with a distal flange configured for seating against the distal cavity at the bore relief to prevent further proximal travel of the actuator within the tool body.

13. The system of any of embodiments 1-12 wherein the actuator is formed with a proximal shank configured for sliding within a proximal tool through-hole formed in the tool bore proximal of the bore relief.

14. The system of embodiment 13 wherein the tool through-hole is smaller than the bore relief.

15. The system of embodiment 13 or embodiment 14 wherein the shank is formed with an outwardly-opening proximal o-ring groove having a proximal o-ring seated therein for slidably and sealingly engaging between the shank and the tool through-hole for sealing the tool proximally.

16. The system of any of embodiments 13-15 wherein the shank is operably coupled with a knob threadably installed on the tool boss, whereby rotation and axial travel of the knob on the tool boss axially shifts the actuator within the tool bore.

17. The system of embodiment 16 wherein the knob is formed having a knob cavity for threadable engagement with the tool boss.

18. The system of embodiment 16 or embodiment 17 wherein a proximally-opening hole is formed in the shank for engagement with the knob through a corresponding knob bore.

19. The system of any of embodiments 16-18 wherein a proximally-facing shoulder is formed on the shank for engagement with the knob.

20. The system of any of embodiments 1-19 wherein the actuator is formed with an intermediate actuator relief configured to provide a flow path about the actuator between the actuator and the tool bore, the actuator relief being at least partially opposite the bore relief.

21. The system of any of embodiments 1-20 wherein the connector is formed having an exterior connector relief at least partially opposite the interior bore relief and having at least one connector cross-hole communicating between the connector relief and the bore relief, thereby allowing for fluid flow from the bore relief into the connector relief.

22. The system of embodiment 21 wherein a first swivel member having a first swivel bore is rotatably installed on the connector spanning the connector relief.

23. The system of embodiment 22 wherein the connector is formed having an outwardly-opening connector undercut and a connector retaining ring is installed in the connector undercut for retention of the first swivel member.

24. The system of embodiment 22 or embodiment 23 wherein the connector is further formed with opposite outwardly-opening connector o-ring grooves adjacent the connector relief and having connector o-rings seated therein for sealingly engaging between the connector and the first swivel bore, thereby sealing the first swivel member on the connector and the flow path through the connector relief and the first swivel bore.

25. The system of embodiment 24 wherein the first swivel member is formed having a laterally-extending swivel post having a post bore therethrough in fluid communication with the first swivel bore between the opposite connector o-rings.

26. The system of embodiment 25 wherein the swivel post is formed having a post relief having at least one post cross-hole communicating between the post relief and the post bore, thereby allowing for fluid flow from the post bore into the post relief.

27. The system of embodiment 26 wherein a second swivel member having a second swivel bore is rotatably installed on the swivel post spanning the post relief.

28. The system of embodiment 27 wherein the second swivel member seats against a post shoulder of the first swivel member and is retained on the swivel post by a fastener threadably engaged with the post bore.

29. The system of embodiment 27 or embodiment 28 wherein the swivel post is further formed with opposite outwardly-opening post o-ring grooves adjacent the post relief and having post o-rings seated therein for sealingly engaging between the swivel post and the second swivel bore, thereby sealing the second swivel member on the first swivel member and the flow path through the post relief and the second swivel bore.

30. The system of embodiment 29 wherein the second swivel member is formed having a second swivel through-hole intersecting and in fluid communication with the second swivel bore between the opposite post o-rings, the second swivel through-hole defining an outlet of the tool.

31. The system of any of embodiments 1-30 wherein the plug head is formed having opposite plug flats for gripping and rotating the plug.

32. The system of any of embodiments 1-31 wherein the safety cap is formed with a cap cavity for threadable engagement with the plug boss.

33. The system of any of embodiments 1-32 wherein the safety cap is formed with a cap head having opposite cap flats for gripping and rotating the cap.

34. The system of any of embodiments 1-33 wherein the tool body is further formed having an intermediate tool head between the distal connector and the proximal tool boss, the tool head configured for selectively gripping and rotating the connector.

35. The system of any of embodiments 1-34 wherein the plug is formed integrally from pre-heat-treated 17-4 steel.

36. The system of any of embodiments 1-35 wherein the cap is formed integrally from 6061 aluminum.

37. The system of embodiment 36 wherein the cap is anodized.

38. The system of any of embodiments 1-37 wherein the plunger is formed integrally from 360 brass.

39. The system of any of embodiments 1-38 wherein the spring is rated at 750 to 800 grams installed.

40. The system of any of embodiments 1-39 wherein the connector o-ring is formed from fluoroelastomer polymer ("FKM") rubber.

41. A method of employing an oil evacuation system as defined in any one of embodiments 1-40, the method comprising the steps of: installing the plug in the drain hole of the oil pan, the plug having the plunger seated within the plug bore and thereby closing the plug in a first operational mode; removing the cap from the plug; connecting the tool to the plug remaining in the first operational mode; and rotating the knob of the tool in a first direction so as to shift the knob and thus the actuator distally to engage the distal tip of the actuator with the plunger within the plug to shift the plunger distally to unseat the plunger from the plug bore and open both the plug and the tool for oil flow therethrough in a second operational mode.

42. The method of embodiment 41 wherein the step of installing the plug comprises torquing the plug to manufacturer specifications.

43. The method of embodiment 41 or embodiment 42 wherein the step of connecting the tool to the plug comprises rotating the connector to threadably engage the connector with the plug boss.

44. The method of embodiment 43 wherein the step of rotating the connector comprises grasping and rotating the tool head while not rotating the knob relative to the tool body.

45. The method of any of embodiments 41-44, prior to the step of rotating the knob of the tool, further comprising the step of rotating one or both of the first and second swivel members to locate the tool fluid outlet defined by the second swivel through-hole as desired.

46. The method of any of embodiments 41-45, upon completion of oil drainage from the oil pan, further comprising the step of rotating the knob of the tool in a second direction opposite the first direction so as to shift the knob and thus the actuator proximally to disengage the distal tip of the actuator from the plunger within the plug to allow the plunger to again seat within the plug bore and close both the plug and the tool in the first operational mode.

47. The method of embodiment 46, upon rotating the knob of the tool in the second direction to again close the plug and tool, further comprising the step of threadably disengaging the connector from the plug boss.

48. The method of embodiment 47, upon threadably disengaging the connector from the plug boss, comprising the further step of threadably installing the cap on the plug boss.

49. The method of embodiment 48, wherein the step of threadably installing the cap comprises torquing the cap to 60 cN-m to compress and seat and seal against the plug o-ring.

50. A kit comprising an oil evacuation system as defined in any one of embodiments 1-40.

51. The kit of embodiment 50, further comprising instructional material.

52. The kit of embodiment 51, wherein the instructional material provides instructions on how to perform the method as defined in any one of embodiments 41-49.

53. Use of an oil evacuation system as defined in any one of embodiments 1-40 to selectively drain oil from an oil pan.

54. The use of embodiment 53, wherein the use comprises a method as defined in any one of embodiments 41-49.

In closing, regarding the exemplary embodiments of the present invention as shown and described herein, it will be appreciated that an oil evacuation system is disclosed and configured for selecting draining oil from an oil pan. Because the principles of the invention may be practiced in a number of configurations beyond those shown and described, it is to be understood that the invention is not in any way limited by the exemplary embodiments, but is generally directed to an oil evacuation system that may take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are expressly indicated or to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An oil evacuation system for draining oil from an oil pan having a drain hole, the system comprising:

an oil drain plug having a distal threaded plug shaft, an intermediate plug head, and a proximal plug boss, the plug shaft configured to threadably engage the oil pan drain hole, the plug head having a distally-facing surface, the oil drain plug further having an axial plug bore therealong, the plug bore having formed therein an expanded relatively larger diameter throat opposite the plug head bounded proximally by a relatively smaller diameter through-hole and distally by the relatively smaller diameter plug bore, the expanded relatively larger diameter throat not extending distally beyond the distally-facing surface of the plug head and tapering to the relatively smaller diameter plug bore opposite the plug shaft, the oil drain plug further having a plunger positioned within the throat and configured to selectively seal the plug bore under the biasing effect of a spring extending distally from the plunger, whereby the expanded throat in cooperation with the stabilizing and biasing spring allows relative movement of the plunger within the plug bore and specifically the throat to selectively open and close the plug bore;

a safety cap configured for selective engagement with the plug boss for selectively proximally covering the oil drain plug; and an oil drain tool configured for selective operable installation on the oil drain plug upon removal of the safety cap when the oil drain plug is installed in the drain hole and oil is to be drained from the oil pan, the oil drain tool comprising a body having a distal connector configured to engage the plug boss, the oil drain tool further having an axial tool bore therealong, the tool bore having a distal cavity defining the connector, the oil drain tool further having an actuator slidably installed and selectively sealingly positioned within the tool bore and configured for selective engagement with the plunger;

wherein an uncapped stand-off of the oil drain plug from a distal surface of the plug head to a proximal surface of the plug boss is less than nine millimeters (9 mm) and with the safety cap installed on the plug boss a capped stand-off from the distal surface of the plug head to the proximal surface of the safety cap is less than ten millimeters (10 mm), whereby the oil drain plug has a relatively low profile when installed in the drain hole of the oil pan for shear resistance and safety in the event of an impact to the oil drain plug; and wherein during use when the oil drain plug is installed in the drain hole and oil is to be drained from the oil pan, upon removal of the safety cap from the oil drain plug and installation of the oil drain tool on the plug boss of the oil drain plug, actuation of the actuator of the oil drain tool causes the actuator to unseat within the tool bore and open the oil drain tool and further causes the actuator to engage and unseat the plunger of the oil drain plug within the plug bore and open the oil drain plug and thereby allow oil to flow through the oil drain plug around the plunger and through the oil drain tool around the actuator, whereby in reverse upon retraction of the actuator, the oil drain plug closes as by the plunger re-seating in the throat under the biasing effect of the spring before the actuator re-seats within the tool bore and the oil drain tool again closes to ensure that no residual oil remains in the distal cavity as the oil drain tool is disconnected from the oil drain plug.

2. The system of claim 1 wherein the plug shaft is formed with an exterior circumferential groove thereabout and a cross-hole communicating between the groove and the plug bore, thereby allowing for fluid flow from the exterior of the plug shaft into the plug bore.

3. The system of claim 1 wherein:

an edge surface is defined between the through-hole and the throat, whereby the plunger selectively seats and seals against the edge surface; and the plunger is formed having a proximally-facing domed plunger surface configured for seating and sealing against the edge surface and is further formed having a distally-facing planar shoulder opposite of the domed plunger surface for stable receipt of a relatively smaller proximal end of the spring.

4. The system of claim 1 wherein an axial proximally-opening countersunk hole is formed in the plunger and configured for selective receipt of a distal tip of the actuator in selectively engaging and unseating the plunger within the plug bore, the distal tip of the actuator accessing the countersunk hole of the plunger through the plug through-hole.

5. The system of claim 1 further comprising an o-ring seated on the plug boss adjacent to the plug head and configured for sealingly engaging the safety cap or the connector of the oil drain tool in use, whereby the o-ring forms a seal with and helps retain the safety cap or the connector on the oil drain plug.

6. The system of claim 1 wherein the actuator is formed with a distal collar proximal of a distal tip, the collar configured for selectively sliding within a bore relief of the tool bore and formed with an outwardly-opening distal o-ring groove having a distal o-ring seated therein for slidably and sealingly engaging between the collar and the bore relief for selectively sealing the oil drain tool distally.

7. The system of claim 6 wherein the collar is formed with a distal flange configured for seating against the distal cavity at the bore relief to prevent further proximal travel of the actuator within the tool body.

8. The system of claim 6 wherein:

the actuator is formed with a proximal shank configured for sliding within a proximal tool through-hole formed in the tool bore proximal of the bore relief;

the shank is formed with an outwardly-opening proximal o-ring groove having a proximal o-ring seated therein for slidably and sealingly engaging between the shank and the tool through-hole for sealing the oil drain tool proximally; and the shank is operably coupled with a knob threadably installed on a threaded tool boss formed proximally on the body of the oil drain tool, whereby rotation and axial travel of the knob on the tool boss axially shifts the actuator within the tool bore.

9. The system of claim 1 wherein the actuator is formed with an intermediate actuator relief configured to provide a flow path about the actuator between the actuator and the tool bore, the actuator relief being at least partially opposite a bore relief formed in the tool bore.

10. The system of claim 1 wherein the connector is formed having an exterior connector relief at least partially opposite a bore relief formed in the tool bore and having at least one connector cross-hole communicating between the connector relief and the bore relief, thereby allowing for fluid flow from the bore relief into the connector relief.

11. The system of claim 10 wherein a first swivel member having a first swivel bore is rotatably installed on the connector spanning the connector relief.

12. The system of claim 11 wherein the connector is further formed with opposite outwardly-opening connector o-ring grooves adjacent the connector relief and having connector o-rings seated therein for sealingly engaging between the connector and the first swivel bore, thereby sealing the first swivel member on the connector and the flow path through the connector relief and the first swivel bore.

13. The system of claim 12 wherein the first swivel member is formed having a laterally-extending swivel post having a post bore therethrough in fluid communication with the first swivel bore between the opposite connector o-rings.

14. The system of claim 13 wherein the swivel post is formed having a post relief having at least one post cross-hole communicating between the post relief and the post bore, thereby allowing for fluid flow from the post bore into the post relief.

15. The system of claim 14 wherein a second swivel member having a second swivel bore is rotatably installed on the swivel post spanning the post relief.

16. The system of claim 15 wherein the swivel post is further formed with opposite outwardly-opening post o-ring grooves adjacent the post relief and having post o-rings seated therein for sealingly engaging between the swivel post and the second swivel bore, thereby sealing the second swivel member on the first swivel member and the flow path through the post relief and the second swivel bore.

17. The system of claim 16 wherein the second swivel member is formed having a second swivel through-hole intersecting and in fluid communication with the second swivel bore between the opposite post o-rings, the second swivel through-hole defining an outlet of the oil drain tool.

18. An oil evacuation system for draining oil from an oil pan having a drain hole, the system comprising:

an oil drain plug having a distal threaded plug shaft, an intermediate plug head, and a proximal plug boss, the plug shaft configured to threadably engage the oil pan drain hole, the plug head having a distally-facing surface, the oil drain plug further having an axial plug bore therealong, the plug bore having formed therein an expanded relatively larger diameter throat opposite the plug head bounded proximally by a relatively smaller diameter through-hole and distally by the relatively smaller diameter plug bore, the expanded relatively larger diameter throat not extending distally beyond the distally-facing surface of the plug head and tapering to the relatively smaller diameter plug bore opposite the plug shaft, the oil drain plug further having a plunger positioned within the throat and configured to selectively seal the plug bore, whereby the expanded throat allows relative movement of the plunger within the plug bore and specifically the throat to selectively open and close the plug bore;

a safety cap configured for selective engagement with the plug boss for selectively proximally covering the oil drain plug; and an oil drain tool configured for selective operable installation on the oil drain plug upon removal of the cap when the oil drain plug is installed in the drain hole and oil is to be drained from the oil pan, the oil drain tool comprising a body having a distal connector configured to engage the plug boss and further having a proximal threaded tool boss, the oil drain tool further having an axial tool bore therealong, the tool bore having a distal cavity defining the connector and further having an intermediate bore relief, the oil drain tool further having an actuator slidably installed and selectively sealingly positioned within the tool bore, the actuator having a distal tip configured for selective engagement with the plunger of the oil drain plug, the actuator further having a proximal shank configured for sliding within a proximal tool through-hole formed in the tool bore proximal of the bore relief, the shank operably coupled with a knob threadably installed on the tool boss, whereby rotation and axial travel of the knob on the tool boss axially shifts the actuator within the tool bore;

wherein during use when the oil drain plug is installed in the drain hole and oil is to be drained from the oil pan, upon removal of the safety cap from the oil drain plug and installation of the oil drain tool on the plug boss of the oil drain plug, actuation of the actuator of the oil drain tool through rotation of the knob causes the actuator to unseat within the tool bore and open the oil drain tool and further causes the actuator to engage and unseat the plunger of the oil drain plug within the plug bore and open the oil drain plug and thereby allow oil to flow through the oil drain plug around the plunger and through the oil drain tool around the actuator, whereby in reverse upon retraction of the actuator through counter-rotation of the knob, the oil drain plug closes as by the plunger re-seating in the throat before the actuator re-seats within the tool bore and the oil drain tool again closes to ensure that no residual oil remains in the distal cavity as the oil drain tool is disconnected from the oil drain plug.

19. An oil evacuation system for draining oil from an oil pan having a drain hole, the system comprising:

an oil drain plug having a distal threaded plug shaft, an intermediate plug head, and a proximal plug boss, the plug shaft configured to threadably engage the oil pan drain hole, the plug head having a distally-facing surface, the oil drain plug further having an axial plug bore therealong, the plug bore having formed therein an expanded relatively larger diameter throat opposite the plug head, the plug bore further having formed therein a through-hole proximal of and relatively smaller than the throat, an edge surface thereby being defined between the through-hole and the throat, and the plug bore distal of the throat being relatively smaller than the throat, the expanded relatively larger diameter throat not extending distally beyond the distally-facing surface of the plug head and tapering to the relatively smaller diameter plug bore opposite the plug shaft, the oil drain plug further having a plunger positioned within the throat and configured to selectively seal the plug bore under the biasing effect of a spring extending distally from the plunger, the plunger formed having a proximally-facing domed plunger surface configured for seating and sealing against the edge surface and further formed having a distally-facing planar shoulder opposite of the domed plunger surface for stable receipt of a relatively smaller proximal end of the spring, whereby the expanded throat in cooperation with the stabilizing and biasing spring allows relative movement of the plunger within the plug bore and specifically the throat to selectively open and close the plug bore;

a safety cap configured for selective engagement with the plug boss for selectively proximally covering the oil drain plug; and an oil drain tool configured for selective operable installation on the oil drain plug upon removal of the safety cap when the oil drain plug is installed in the drain hole and oil is to be drained from the oil pan, the oil drain tool comprising a body having a distal connector configured to engage the plug boss, the oil drain tool further having an axial tool bore therealong, the tool bore having a distal cavity defining the connector, the oil drain tool further having an actuator slidably installed and selectively sealingly positioned within the tool bore and configured for selective engagement with the plunger;

wherein an uncapped stand-off of the oil drain plug from a distal surface of the plug head to a proximal surface of the plug boss is less than nine millimeters (9 mm) and with the safety cap installed on the plug boss a capped stand-off from the distal surface of the plug head to the proximal surface of the safety cap is less than ten millimeters (10 mm), whereby the oil drain plug has a relatively low profile when installed in the drain hole of the oil pan for shear resistance and safety in the event of an impact to the oil drain plug; and wherein during use when the oil drain plug is installed in the drain hole and oil is to be drained from the oil pan, upon removal of the safety cap from the oil drain plug and installation of the oil drain tool on the plug boss of the oil drain plug, actuation of the actuator of the oil drain tool causes the actuator to unseat within the tool bore and open the oil drain tool and further causes the actuator to engage and unseat the plunger of the oil drain plug within the plug bore and open the oil drain plug and thereby allow oil to flow through the oil drain plug around the plunger and through the oil drain tool around the actuator, whereby in reverse upon retraction of the actuator, the oil drain plug closes as by the domed plunger surface re-seating against the through-hole edge surface under the biasing effect of the spring on the plunger before the actuator re-seats within the tool bore and the oil drain tool again closes to ensure that no residual oil remains in the distal cavity as the oil drain tool is disconnected from the oil drain plug.

20. An oil evacuation system for draining oil from an oil pan having a drain hole, the system comprising:

an oil drain plug having a distal threaded plug shaft, an intermediate plug head, and a proximal plug boss, the plug shaft configured to threadably engage the oil pan drain hole, the oil drain plug further having an axial plug bore therealong, the oil drain plug further having a plunger positioned within the plug bore and configured to selectively seal the plug bore under the biasing effect of a spring extending distally from the plunger;

a safety cap configured for selective engagement with the plug boss for selectively proximally covering the oil drain plug; and an oil drain tool configured for selective operable installation on the oil drain plug upon removal of the safety cap when the oil drain plug is installed in the drain hole and oil is to be drained from the oil pan, the oil drain tool comprising a body having a distal connector configured to engage the plug boss, the oil drain tool further having an axial tool bore therealong, the tool bore having a distal cavity defining the connector, the oil drain tool further having an actuator slidably installed and selectively sealingly positioned within the tool bore and configured for selective engagement with the plunger;

wherein the actuator of the oil drain tool is formed with a distal collar proximal of a distal tip, the collar configured for selectively sliding within a bore relief of the tool bore and formed with an outwardly-opening distal o-ring groove having a distal o-ring seated therein for slidably and sealingly engaging between the collar and the bore relief for selectively sealing the oil drain tool distally, and further wherein the actuator is formed with a proximal shank configured for sliding within a proximal tool through-hole formed in the tool bore proximal of the bore relief, the shank being formed with an outwardly-opening proximal o-ring groove having a proximal o-ring seated therein for slidably and sealingly engaging between the shank and the tool through-hole for sealing the oil drain tool proximally, and further wherein the shank is operably coupled with a knob threadably installed on a threaded tool boss formed proximally on the body of the oil drain tool, whereby rotation and axial travel of the knob on the tool boss axially shifts the actuator within the tool bore; and wherein during use when the oil drain plug is installed in the drain hole and oil is to be drained from the oil pan, upon removal of the safety cap from the oil drain plug and installation of the oil drain tool on the plug boss of the oil drain plug, actuation of the actuator of the oil drain tool causes the actuator to unseat within the tool bore and open the oil drain tool and further causes the actuator to engage and unseat the plunger of the oil drain plug within the plug bore and open the oil drain plug and thereby allow oil to flow through the oil drain plug around the plunger and through the oil drain tool around the actuator, whereby in reverse upon retraction of the actuator, the oil drain plug closes as by the plunger re-seating within the plug bore under the biasing effect of the spring before the actuator re-seats within the tool bore and the oil drain tool again closes to ensure that no residual oil remains in the distal cavity as the oil drain tool is disconnected from the oil drain plug.

21. An oil evacuation system for draining oil from an oil pan having a drain hole, the system comprising:

an oil drain plug having a distal threaded plug shaft, an intermediate plug head, and a proximal plug boss, the plug shaft configured to threadably engage the oil pan drain hole, the oil drain plug further having an axial plug bore therealong, the oil drain plug further having a plunger positioned within the plug bore and configured to selectively seal the plug bore under the biasing effect of a spring extending distally from the plunger;

a safety cap configured for selective engagement with the plug boss for selectively proximally covering the oil drain plug; and an oil drain tool configured for selective operable installation on the oil drain plug upon removal of the safety cap when the oil drain plug is installed in the drain hole and oil is to be drained from the oil pan, the oil drain tool comprising a body having a distal connector configured to engage the plug boss, the oil drain tool further having an axial tool bore therealong, the tool bore having a distal cavity defining the connector, the oil drain tool further having an actuator slidably installed and selectively sealingly positioned within the tool bore and configured for selective engagement with the plunger;

wherein the connector of the oil drain tool is formed having an exterior connector relief at least partially opposite a bore relief formed in the tool bore and having at least one connector cross-hole communicating between the connector relief and the bore relief, thereby allowing for fluid flow from the bore relief into the connector relief, a first swivel member having a first swivel bore is rotatably installed on the connector spanning the connector relief, the connector is further formed with opposite outwardly-opening connector o-ring grooves adjacent the connector relief and having connector o-rings seated therein for sealingly engaging between the connector and the first swivel bore, thereby sealing the first swivel member on the connector and the flow path through the connector relief and the first swivel bore, the first swivel member is formed having a laterally-extending swivel post having a post bore therethrough in fluid communication with the first swivel bore between the opposite connector o-rings, the swivel post is formed having a post relief having at least one post cross-hole formed through the swivel post perpendicular to the post bore and communicating between the post relief and the post bore, thereby allowing for fluid flow from the post bore into the post relief, and a second swivel member having a second swivel bore is rotatably installed on the swivel post spanning the post relief; and wherein during use when the oil drain plug is installed in the drain hole and oil is to be drained from the oil pan, upon removal of the safety cap from the oil drain plug and installation of the oil drain tool on the plug boss of the oil drain plug, actuation of the actuator of the oil drain tool causes the actuator to unseat within the tool bore and open the oil drain tool and further causes the actuator to engage and unseat the plunger of the oil drain plug within the plug bore and open the oil drain plug and thereby allow oil to flow through the oil drain plug around the plunger and through the oil drain tool around the actuator, whereby in reverse upon retraction of the actuator, the oil drain plug closes as by the plunger re-seating within the plug bore under the biasing effect of the spring before the actuator re-seats within the tool bore and the oil drain tool again closes to ensure that no residual oil remains in the distal cavity as the oil drain tool is disconnected from the oil drain plug.

22. An oil evacuation system for draining oil from an oil pan having a drain hole, the system comprising:

an oil drain plug having a distal threaded plug shaft, an intermediate plug head, and a proximal plug boss, the plug shaft configured to threadably engage the oil pan drain hole, the oil drain plug further having an axial plug bore therealong, the oil drain plug further having a plunger positioned within the plug bore and configured to selectively seal the plug bore under the biasing effect of a spring extending distally from the plunger;

a safety cap configured for selective engagement with the plug boss for selectively proximally covering the oil drain plug; and an oil drain tool configured for selective operable installation on the oil drain plug upon removal of the safety cap when the oil drain plug is installed in the drain hole and oil is to be drained from the oil pan, the oil drain tool comprising a body having a distal connector configured to engage the plug boss, the oil drain tool further having an axial tool bore therealong, the tool bore having a distal cavity defining the connector, the oil drain tool further having an actuator slidably installed and selectively sealingly positioned within the tool bore and configured for selective engagement with the plunger;

wherein the actuator of the oil drain tool is formed with a distal collar proximal of a distal tip, the collar configured for selectively sliding within a bore relief of the tool bore and formed with an outwardly-opening distal o-ring groove having a distal o-ring seated therein for slidably and sealingly engaging between the collar and the bore relief for selectively sealing the oil drain tool distally, and further wherein the collar is formed with a distal flange configured for seating against the distal cavity at the bore relief to prevent further proximal travel of the actuator within the tool body; and wherein during use when the oil drain plug is installed in the drain hole and oil is to be drained from the oil pan, upon removal of the safety cap from the oil drain plug and installation of the oil drain tool on the plug boss of the oil drain plug, actuation of the actuator of the oil drain tool causes the actuator to unseat within the tool bore and open the oil drain tool and further causes the actuator to engage and unseat the plunger of the oil drain plug within the plug bore and open the oil drain plug and thereby allow oil to flow through the oil drain plug around the plunger and through the oil drain tool around the actuator, whereby in reverse upon retraction of the actuator, the oil drain plug closes as by the plunger re-seating within the plug bore under the biasing effect of the spring before the actuator re-seats within the tool bore and the oil drain tool again closes to ensure that no residual oil remains in the distal cavity as the oil drain tool is disconnected from the oil drain plug.

* * * * *